US008139982B2

(12) United States Patent
Kitagawa

(10) Patent No.: US 8,139,982 B2
(45) Date of Patent: Mar. 20, 2012

(54) IMAGE FORMATION APPARATUS AND PRINTED ITEM

(75) Inventor: Soichiro Kitagawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 269 days.

(21) Appl. No.: 12/556,362

(22) Filed: Sep. 9, 2009

(65) Prior Publication Data

US 2010/0189964 A1 Jul. 29, 2010

(30) Foreign Application Priority Data

Jan. 28, 2009 (JP) ..... 2009-016379

(51) Int. Cl.
*G03G 15/01* (2006.01)

(52) U.S. Cl. ..... 399/231; 399/223

(58) Field of Classification Search ..... 399/223, 399/224, 231, 298; 428/195.1
See application file for complete search history.

(56) References Cited

U.S. PATENT DOCUMENTS

| | | | | |
|---|---|---|---|---|
| 5,607,534 | A * | 3/1997 | Kawanishi et al. | 156/234 |
| 5,667,927 | A | 9/1997 | Kubota et al. | |
| 5,772,847 | A * | 6/1998 | Simpson et al. | 162/189 |
| 6,678,493 | B2 * | 1/2004 | Maeyama et al. | 399/302 |
| 2003/0073019 | A1 | 4/2003 | Yano et al. | |

FOREIGN PATENT DOCUMENTS

| | | |
|---|---|---|
| EP | 0 713 158 A1 | 5/1996 |
| EP | 1 079 280 A2 | 2/2001 |
| JP | A-07-120975 | 5/1995 |
| JP | A-2000-047428 | 2/2000 |
| JP | A-2002-055491 | 2/2002 |
| JP | A-2002-327047 | 11/2002 |

OTHER PUBLICATIONS

Search Report issued in European Patent Application No. 09170290.2, on Jun. 4, 2010.

* cited by examiner

*Primary Examiner* — David Gray
*Assistant Examiner* — Gregory H Curran
(74) *Attorney, Agent, or Firm* — Oliff & Berridge, PLC

(57) ABSTRACT

The invention provides an image formation apparatus having at least a first toner image-forming unit that forms a first toner image which directly contacts a surface of a recording medium, a second toner image-forming unit that forms a second toner image which is disposed on the first toner image without directly contacting the recording medium, and a fixing unit. The invention further provides a printed item having at least a recording medium, a first toner image directly contacting a surface of the recording medium, and a second toner image residing on the first toner image without directly contacting the recording medium. A contact angle $\theta_1$ of the first toner and the first toner image with respect to an aqueous de-inking solution, is smaller than a contact angle $\theta_2$ of the second toner and the second toner image with respect to the aqueous de-inking solution.

15 Claims, 4 Drawing Sheets

IMAGE FORMATION APPARATUS AND PRINTED ITEM

CROSS-REFERENCE TO RELATED APPLICATION

This application is based on and claims priority under 35 USC 119 from Japanese Patent Application No. 2009-016379 filed on Jan. 28, 2009.

BACKGROUND

1. Technical Field

The present invention relates to an image formation apparatus and a printed item.

2. Related Art

The importance of preserving forest resources has been recognized from the view point of protecting the natural environment over the entire globe. Resource conservation has become an important subject. Recycling of paper used in copying machines, printers, etc. has been proceeding as one means of resource conservation. Examples of the recycling method include de-inking treatment, in which a printed item with toner fixed by an electrophotographic apparatus is beaten into fibers to remove the toner, and then the fibers are again subjected to paper-making.

SUMMARY

A first aspect of the invention is an image formation apparatus comprising a first toner image-forming unit, a second toner image-forming unit and a fixing unit, the first toner image-forming unit comprising:

a first electrostatic latent image holder;

a first electrostatic latent image forming unit that forms a first electrostatic latent image on the surface of the first electrostatic latent image holder;

a first developing unit that develops, with a first developer comprising a first toner, the first electrostatic latent image to form a first toner image; and a first transferring unit that transfers the first toner image to a recording medium so that the first toner image directly contacts a surface of the recording medium, the second toner image-forming unit comprising:

a second electrostatic latent image holder;

a second electrostatic latent image forming unit that forms a second electrostatic latent image on the surface of the second electrostatic latent image holder;

a second developing unit that develops, with a second developer comprising a second toner, the second electrostatic latent image to form a second toner image; and a second transferring unit that transfers the second toner image to the recording medium so that the second toner image is disposed on the first toner image without directly contacting the recording medium, the fixing unit fixing the transferred first toner image and the transferred second toner image on the surface of the recording medium, and a contact angle $\theta_1$, that is the contact angle of the first toner with respect to an aqueous de-inking solution, being smaller than a contact angle $\theta_2$, that is the contact angle of the second toner with respect to the aqueous de-inking solution.

A second aspect of the invention is a printed item comprising a recording medium, a first toner image, and a second toner image, the first toner image directly contacting a surface of the recording medium, the second toner image residing on the first toner image without directly contacting the recording medium, and a contact angle $\theta_1$, that is the contact angle of the first toner image with respect to an aqueous de-inking solution, being smaller than a contact angle $\theta_2$, that is the contact angle of the second toner image with respect to the aqueous de-inking solution.

BRIEF DESCRIPTION OF THE DRAWINGS

Exemplary embodiments of the present invention will be described in detail based on the following figure, wherein.

DETAILED DESCRIPTION

First Exemplary Embodiment

Image Formation Apparatus and Image Formation Method

Figure 1:
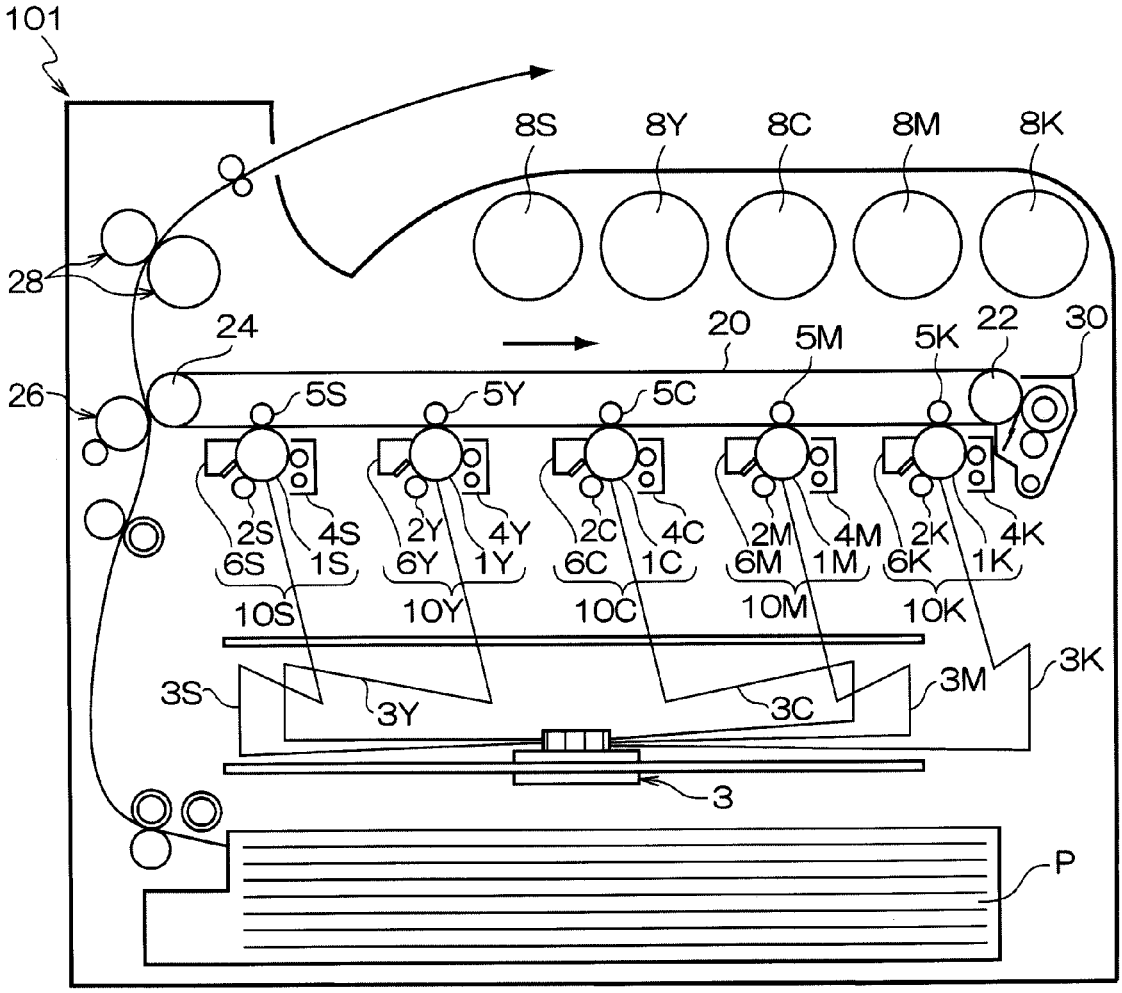
FIG. 1 is a schematic view illustrating an example of an image formation apparatus according to a first exemplary embodiment of the invention.

FIG. 1 is a schematic view illustrating an example of an image formation apparatus according to a first exemplary embodiment of the invention.

An image formation apparatus 101 according to the first exemplary embodiment is, as shown in FIG. 1, a 5-cassette tandem type color image formation apparatus. The image formation apparatus 101 according to the first exemplary embodiment uses a toner which is substantially free of a colorant (hereinafter sometimes referred to as a "colorless toner") as a toner for forming a contact toner image (first toner image) which directly contacts a recording medium (hereinafter sometimes referred to as a "toner for forming a contact toner image").

The image forming apparatus 101 is provided with first to fourth image forming units 10Y, 10M, 10C, and 10K of an electrophotographic system for outputting an image of each color of yellow (Y), magenta (M), cyan (C) and black (K) based on color-separated image data. These image forming units are hereinafter referred to simply as "units". The image forming apparatus 101 is further provided with a fifth image forming unit 10S of an electrophotographic system.

In the exemplary embodiment, a colorless toner image formed by the fifth unit 10S (hereinafter sometimes referred to as "colorless toner image") is formed in all of regions on the surface of the recording paper P where images are present. Accordingly, in a case of forming an image of any color, the colorless toner image is the contact toner image which is in direct contact with the recording paper P.

On the other hand, any of the toner images of black, magenta, cyan, and yellow formed by the first to fourth units 10K, 10M, 10C, and 10Y (hereinafter sometimes referred to as "black toner image", "magenta toner image", "cyan toner image", and "yellow toner image" respectively) are formed only over the portion of the surface of the recording paper P where the colorless toner image is present. Accordingly, the black toner image, the magenta toner image, the cyan toner image, and yellow toner image are non-contact toner images which are formed on the contact toner image and above the surface of the recording paper P with disposing the contact toner image (second toner image) between the recording paper P and the black, magenta, cyan, and yellow toner images.

The units 10Y, 10M, 10C, and 10K are horizontally arranged with a certain space therebetween. The units 10Y, 10M, 10C and 10K may be process cartridges attachable to and detachable from the main body of the image forming apparatus.

Above the respective units 10Y, 10M, 10C and 10K in the Figure, an intermediate transfer belt 20 is arranged as an intermediate transfer body through the respective units. The intermediate transfer belt 20 is arranged by being wound around a driving roller 22 and a support roller 24 in contact with the inner surface of the intermediate transfer belt 20, the rollers 22 and 24 being arranged to be apart from each other from the left to right, and the intermediate transfer belt 20 runs in the direction of from the first unit 10K to the fourth unit 10Y. The support roller 24 is biased with a spring or the like (not shown) so as to be apart from the driving roller 22, and a tension is applied to the intermediate transfer belt 20 wound between the two rollers. An intermediate transfer body cleaning device 30 is provided at a side of the intermediate transfer belt 20 so as to be opposite to the driving roller 22.

Toners of yellow, magenta, cyan, or black-colored (hereinafter sometimes referred as a yellow toner, a magenta, cyan toner, or a black toner) and held in toner cartridges 8K, 8M, 8C or 8Y are respectively supplied to developing device (developing units) 4K, 4M, 4C or 4Y for the respective units 10K, 10M, 10C and 10Y A toner not containing a colorant (hereinafter sometimes referred to as "colorless toner") accommodated in the toner cartridge 8S is supplied to the developing unit 4S of the unit 10S.

In the exemplary embodiment, the colorless toner supplied to the development device 4S of the unit 10S is "toner for forming a contact toner image". Further, the black toner, the magenta toner, the cyan toner, and the yellow toner supplied respectively to the development units 4K, 4M, 4C, and 4Y of the units 10K, 10M, 10C, and 10Y are "toners for forming the non-contact toner image".

In the exemplary embodiment, among the contact angles of the toners used (colorless toner, yellow toner, cyan toner, magenta toner, and black toner) to the aqueous de-inking solution, the contact angle of the colorless toner to the aqueous de-inking solution is the smallest.

That is, defining the contact angle of the colorless toner to the aqueous de-inking solution as $\theta_{11}$ (degree), the contact angle of the yellow toner to the aqueous de-inking solution as $\theta_{21}$ (degree), the contact angle of the cyan toner to the aqueous de-inking solution as $\theta_{22}$ (degree), the contact angle of the magenta toner to the aqueous de-inking solution as $\theta_{23}$ (degree), and the contact angle of the black toner to the aqueous de-inking solution as $\theta_{24}$ (degree), all of relations: $\theta_{11}<\theta_{21}$, $\theta_{11}<\theta_{22}$, $\theta_{11}<\theta_{23}$, and $\theta_{11}<\theta_{24}$ are satisfied.

In the exemplary embodiment, $\theta_{21}$ to $\theta_{24}$ may be in any magnitude correlation relative to each other as long as $\theta_{11}$ has a value smaller than any of the values from $\theta_{21}$ to $\theta_{24}$.

Each of the first to fifth units 10K, 10M, 10C, 10Y and 10S has a configuration similar to one another. Accordingly, only the first unit 10K forming a black image, arranged on the upstream side of the intermediate transfer belt, is herein explained. Explanations of the second to fifth units 10M, 10C, 10Y and 10S are omitted by assigning reference marks given magenta (M), cyan (C), yellow (Y) and colorless (S) in place of given to the equivalent part of the first unit 10K.

The first unit 10K has a photoreceptor 1K (electrostatic latent image holder) which works as an image holding member. A charging roller 2K (charging unit), an exposure device 3 (exposure unit), a development device 4K (developing unit), a primary transfer roller 5K (transfer unit) and a photoreceptor cleaning device 6K (cleaning unit) are sequentially provided around the photoreceptor 1K. The charging roller 2K electrically charges the surface of the photoreceptor 1K. The exposure device 3 exposes the charged surface to laser light 3Y according to color-separated image signals to form an electrostatic latent image. The development unit 4K develops the electrostatic latent image by feeding a charged toner contained in the developer to the electrostatic latent image. The primary transfer roller 5K transfers the resultant toner image onto the intermediate transfer belt 20. The photoreceptor cleaning device 6K removes a toner remaining on the surface of the photoreceptor 1K after primary transfer.

The primary transfer roller 5K is arranged in the inside of the intermediate transfer belt 20 and arranged in a position opposite to the photoreceptor 1K. A bias power source (not shown) for applying primary transfer bias is electrically connected to each of the primary transfer rollers 5K, 5M, 5C, 5Y and 5S. Each bias power source may be controlled by controller (not shown) to change the transfer bias applied to each primary transfer roller.

Hereinafter, an operation of forming a black image in the first unit 10K is described. First, the surface of the photoreceptor 1K is charged at a potential of about −600 V to about −800V with a charging roller 2K prior to operation (charging).

The photoreceptor 1K is formed by disposing a photosensitive layer on an electroconductive substrate having a volume resistivity at 20° C.: $1\times10^{-6}$ Ωcm or less. This photosensitive layer is usually highly resistant (with approximately the same resistance as that of general resin), but upon irradiation with laser ray 3K, changes the specific resistance of the portion irradiated with the laser ray. According to image data for black sent from the controller (not shown), the layer ray 3K is outputted from the exposure device 3 onto the surface of the charged photoreceptor 1K. The photosensitive layer as the surface portion of the photoreceptor 1K is irradiated with the laser ray 3K, whereby an electrostatic latent image in a yellow print pattern is formed on the surface of the photoreceptor 1K (electrostatic latent image forming).

An electrostatic latent image is an image formed on the surface of the photoreceptor 1K by charging. The electrostatic latent is a negative latent image that is obtained by causing the electrification charge of the surface of the photoreceptor 1K to flow due to a reduction in the specific resistance of the irradiated portion of the photosensitive layer, while charge remains on the portion not irradiated with laser ray 3K.

The electrostatic latent image thus formed on the photoreceptor 1K is rotated to a development position with running of the photoreceptor 1K. In this development position, the electrostatic latent image on the photoreceptor 1K is visualized (developed) with the development device 4K (developing).

The black toner is accommodated in the development device 4K. The black toner is stirred in the inside of the development device 4K and thereby frictionally charged and retained on a developer roll (developer-holding member) and has the same polarity (negative polarity) as that of electrification charge on the photoreceptor 1K. Then, the surface of the photoreceptor 1K passes through the development device 4K, thereby allowing the black toner to electrostatically adhere to the electrically neutralized latent image portion on the surface of the photoreceptor 1K, and thus developing the latent image with the black toner. The photoreceptor 1K having the resultant black toner image formed thereon is subsequently delivered, and the toner image developed on the photoreceptor 1K is sent to a primary transfer position.

When the black toner image on the photoreceptor 1K reaches the primary transfer position, a primary transfer bias is applied to the primary transfer roller 5K, and electrostatic force from the photoreceptor 1K to the primary transfer roller 5K acts on the toner image, and the toner image on the photoreceptor 1K is transferred onto the intermediate transfer belt 20. The transfer bias to be applied has polarity (+) reverse to the polarity of the toner (−), and for example, the transfer bias in the fourth unit 10Y is regulated at about +10 μA by the controller (not shown).

On the other hand, the toner remaining on the photoreceptor 1K is removed and recovered by a cleaning device 6K.

The primary transfer bias applied to primary transfer rollers 5M, 5C, 5Y and 5S after second unit 10M is also controlled in the same manner as in the first unit.

The intermediate transfer belt 20 having the black toner image transferred thereon in the first unit 10K is delivered through the second to fifth units 10M, 10C, 10Y and 10S in this order, whereby plural color toner images are transferred to the intermediate transfer belt 20.

Namely, the image formation using all the toners provides an image transferred on the intermediate transfer belt 20, in which the transferred image includes the black toner image, the magenta toner image, the cyan toner image, the yellow toner image, and the colorless toner image stacked in this order from the black toner image, which is nearest to the intermediate transfer belt 20.

The intermediate transfer belt 20 having four color toner images and a colorless toner image transferred thereon through the first to fifth units reaches a secondary transfer part composed of the intermediate transfer belt 20, the support roller 24 in contact with the inner surface of the intermediate transfer belt 20, and a secondary transfer roller 26 (secondary transfer unit) arranged in the side of the image-holding surface of the intermediate transfer belt 20. On one hand, a recording paper P (recording medium) is fed via a feeding mechanism with predetermined timing into a gap between the secondary transfer roller 26 and the intermediate transfer belt 20 that are contacted with each other with pressure, and a secondary transfer bias is applied to the support roller 24. The transfer bias to be applied has the same polarity (−) as the polarity of the toner (−), and electrostatic force from the intermediate transfer belt 20 to the recording paper P acts on the toner image, and the toner image on the intermediate transfer belt 20 is transferred onto the recording paper P (transferring). The secondary transfer bias is determined depending on resistance detected by a resistance detector (not shown) for detecting the resistance of the secondary transfer part and is voltage-controlled.

The toner image transferred on the recording paper P includes the colorless toner image, the yellow toner image, the cyan toner image, the magenta toner image, and the black toner image stacked in this order from the colorless toner image, which is nearest to the recording paper P. The colorless toner image is the contact toner image which directly contacts the recording paper P, and the yellow toner image, the cyan toner image, the magenta toner image, and the black toner image are non-contact toner images.

Thereafter, the recording paper P is sent to a fixing device 28 (fixing unit) where the composite toner image is heated, and the componential color toner images are coalesced and fixed on the recording paper P (fixing). After completion of the fixation of the color image, the recording paper P is delivered toward an ejection portion to finish a series of the color-image forming operations.

In the image formation apparatus 101 of the exemplary embodiment, the contact angle of the colorless toner, which is a toner forming the contact toner image, is smaller than the contact angles of any of the black toner, the magenta toner, the cyan toner, and the yellow toner, which are the toners for forming the non-contact toner image to the aqueous de-inking solution.

A toner to be considered in a case of recycling paper as the recording medium is "hairy toner", which penetrates deeply into the paper due to fixing and is entangled with paper fibers. Among the toner images fixed to the paper, toners fixed to a region nearest to the paper may tend to form the hairy toner, while toners present at a position apart from the paper may often be disintegrated sufficiently by a mechanical treatment such as kneading.

In a case of forming an image by transferring and fixing plural toner images with stacking them sequentially, penetration of an aqueous de-inking solution to the toner for forming a contact toner image may be improved by making the contact angle of a toner (toner for forming a contact toner image) used for forming a toner image fixed to a region nearest to the paper, that is, a toner image fixed in contact with the paper (contact toner image) to the aqueous de-inking solution. As a result, the effect of separating the toner from the paper fibers by the de-inking agent in the de-inking may be improved.

On the other hand, in a case where the contact angle of the toner for forming the non-contact toner image to the aqueous de-inking solution is excessively small, hygroscopicity of the toner may increase by the increase of the hydrophilicity of the toner. Therefore, the toner may absorb water (particularly under a high humidity circumstance), which phenomenon may lead to decrease in charging, which may sometimes result in deterioration of the image quality.

On the other hand, in the exemplary embodiment of the invention, the contact angle of the toners used for the toner images other than the contact toner image, that is, the contact angle of all of the toner used for the non-contact toner images (toner for forming the non-contact toner image) to the aqueous de-inking solution, is larger than the contact angle of the toner for forming a contact toner image to the aqueous de-inking solution. This may suppress excessive increase of the hydrophilicity of the toner for forming the non-contact toner image.

In the image formation apparatus 101 of the exemplary embodiment, each of the value of $\theta_{21}-\theta_{11}$, the value of $\theta_{22}-\theta_{11}$, the value of $\theta_{23}-\theta_{11}$, and the value of $\theta_{24}-\theta_{11}$ may be in the range of from about 2.5° to about 10° or less. When the contact angles satisfy this condition, the de-inking property of the toner image formed thereby may be further improved, and deterioration of the image quality due to the lowering toner charge may be suppressed.

In the image formation apparatus 101 of the exemplary embodiment, the L* value of the colorless toner as the toner for forming a contact toner images may be larger compared with the L* values of the black toner, the magenta toner, the cyan toner, and the yellow toner as the toner for forming the non-contact toner image. That is, in the exemplary embodiment, a toner having the largest L* value in all of the toners may be employed as the toner for forming the contact toner image. When the image formation apparatus 101 has such a configuration, coloration by the residual toner may be suppressed due to the large L* value of the remaining toner (residual toner), even when the toner for forming a contact toner image remains after the de-inking treatment.

In the image formation apparatus 101 of the exemplary embodiment, since a colorless toner is used as the toner for forming a contact toner image and the colorless toner does not substantially affect the color of other coloring toners, the color reproducibility of the image may be good.

In the image formation apparatus 101 of the exemplary embodiment, while the contact angles of the toners to the aqueous de-inking solution and the L* values thereof are as explained above, the contact angles and the L* values are not limited thereto as long as the condition that the contact angle of the colorless toner to the aqueous de-inking solution is smaller than the contact angle of other toners to the aqueous de-inking solution is satisfied.

While the colorless toner is used as the toner for forming a contact toner image in the image formation apparatus 101 of the exemplary embodiment, the toner for forming a contact toner image is not limited to this, and a toner which is colored yellow, cyan, magenta, or black may also be used, or a toner which is colored to any other color may also be used therefor. Specific examples of the toner for forming a contact toner image which may be employed instead of the colorless toner include a yellow toner, which gives smallest effect on the color among the four colors, and a toner which has a color nearest to the color of the recording paper P.

While the image formation apparatus 101 of the exemplary embodiment has a configuration in which the intermediate transfer belt 20 is delivered to the units 10K, 10M, 10C, 10Y, and 10S in this sequence, the delivery sequence to units 10K, 10M, 10C, and 10Y may be altered as long as the unit 10S is the last unit to which the belt is delivered.

While the image formation apparatus 101 of the exemplary embodiment has a configuration of transferring a toner image via the intermediate transfer belt 20 to the recording paper P, the configuration of the image formation apparatus is not restricted only thereto, and it may have a structure in which the toner image is directly transferred from a photoreceptor to the recording paper. In a case that the toner image is directly transferred from the photoreceptor to the recording paper, the toner image which is in direct contact with the recording paper P is the contact toner image.

While the image formation apparatus 101 of the exemplary embodiment has a configuration in which all the toner images stacked over the intermediate transfer belt 20 are transferred to the recording paper P by the secondary transfer roller 26, the transfer of the toner image is not restricted only thereto, and it may have a configuration in which respective toner images are respectively transferred to the recording paper.

While the image formation apparatus 101 of the exemplary embodiment is a 5-cassette tandem system color image formation apparatus, it is not restricted only thereto, and it may be a rotary system image formation apparatus or the like.

Printed Item

Figure 2:
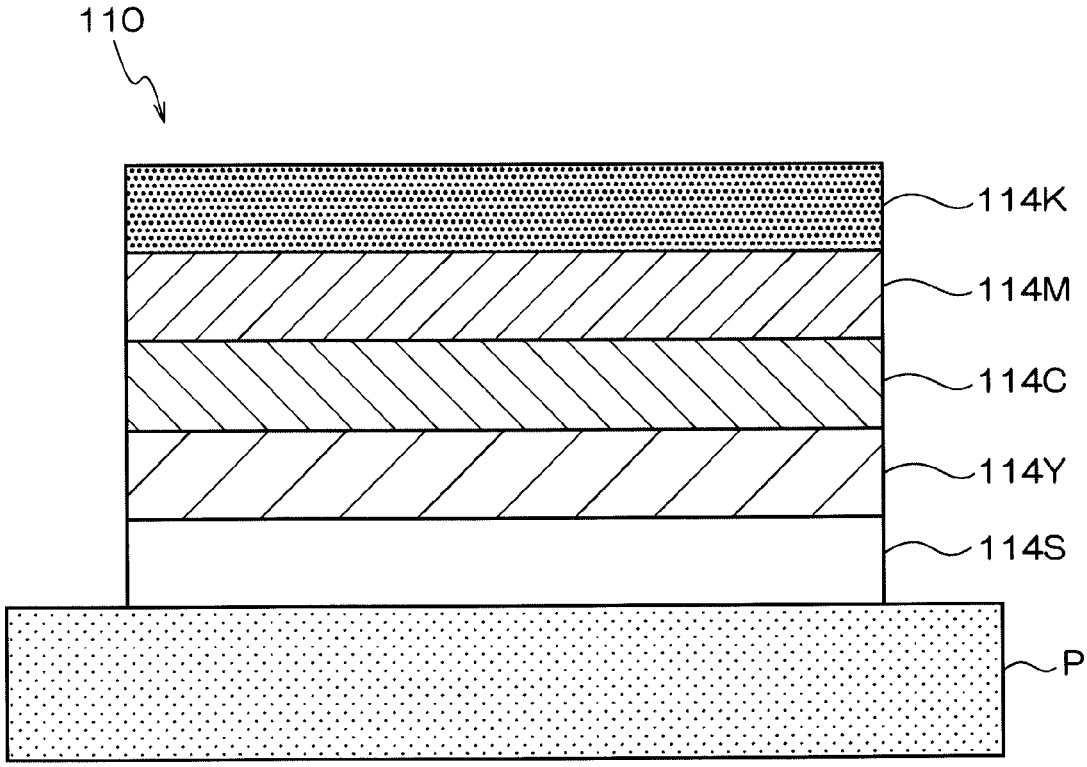
FIG. 2 is a cross-sectional view illustrating an example of a printed item produced by the image formation apparatus according to the first exemplary embodiment of the invention.

FIG. 2 is a cross-sectional view illustrating an example of a printed item produced by the image formation apparatus according to the first exemplary embodiment of the invention.

The printed item 110 is produced by the image formation apparatus 101 using all the colors of the colorless toner, the yellow toner, the cyan toner, the magenta toner, and the black toner.

The printed item 110 specifically has the recording paper P (recoding medium), a colorless toner image 114S (contact toner image) which is formed in direct contact with the surface of the recording paper P, and a yellow toner image 114Y, a cyan toner image 114C, a magenta toner image 114M, and a black toner image 114K (non-contact toner images) which are formed on the colorless toner image 114S and above the recording paper P with disposing the colorless toner image 114S between the recording paper P and the yellow toner image 114Y, the cyan toner image 114C, the magenta toner image 114M, and the black toner image 114K.

Namely, the colorless toner image 114S, the yellow toner image 114Y, the cyan toner image 114C, the magenta toner image 114M, and the black toner image 114K are stacked in this order from the colorless toner image, which is nearest to the recording paper P.

The colorless toner image is the contact toner image, and the yellow toner image 114Y, the cyan toner image 114C, the magenta toner image 114M, and the black toner image 114K are non-contact toner images.

Details of the recording paper P is explained below. The toner images may be formed on the recording paper P by the image formation apparatus 101 using the corresponding toners. A method of forming the toner images accords to the mode explained for the operation of the image formation apparatus 101.

In the printed item 110 of the exemplary embodiment, images are formed by using the image formation apparatus 101. Accordingly, among the contact angles of all toner images (the colorless toner image 114S, the yellow toner image 114Y, the cyan toner image 114C, the magenta toner image 114M, and the black toner image 114K) to the aqueous de-inking solution, the contact angle of the colorless toner image 114S to the aqueous de-inking solution is the smallest.

Further, in the exemplary embodiment, the differences in the contact angle of the toner image to the aqueous de-inking solution (the value of $\theta_{21}-\theta_{11}$, the value of $\theta_{22}-\theta_{11}$, the value of $\theta_{23}-\theta_{11}$, and the value of $\theta_{24}-\theta_{11}$) are similar to the difference in the contact angle of the toner to the aqueous de-inking solution. Accordingly, de-inking property and image quality of the printed item 110 of the exemplary embodiment may be further improved.

Further, in the exemplary embodiment, the L* value of the toner image in the CIE 1976 (L*a*b*) color system is similar to the L* value of the toner described above. Accordingly, in the printed item 110 of the exemplary embodiment, coloration by the residual toner after the de-inking treatment may be suppressed.

While the images are formed by using all toners in the printed item 110, the printed item produced by the image formation apparatus 101 of the exemplary embodiment is not restricted thereto. Toners used therefor may be selected in accordance with the color of images to be formed. In any case, when an image of any color is formed, the colorless toner image 114S is formed in direct contact with the surface of the recording paper P, and other color toner images are formed each alone or in a stacked manner of plural thereof on the colorless toner image 114S and above the recording paper P with disposing the colorless toner image 114S between the recording paper P and the other color toner images. The colorless toner image 114S is formed over the entire image area and serves as the background.

While the conditions of the contact angles of the toner images to the aqueous de-inking solution and the L* values of the toner images in the CIE 1976 (L*a*b*) color system in the exemplary embodiment are set as explained above, the conditions of the contact angles of the toner images to the aqueous de-inking solution and the L* values of the toner images in the CIE 1976 (L*a*b*) color system are not limited to these, and may be varied as long as the contact angle of the colorless toner image 114S to the aqueous de-inking solution is smaller than any other toner images.

While the colorless toner image 114S is used as the contact toner image in the exemplary embodiment, the contact toner image is not restricted thereto. Specific examples of the toner image employable as the contact toner image instead of the colorless toner image 114S include a yellow toner image and a toner image which has a color close to that of the recording paper P.

While the toner images in the printed item 110 are formed in the sequence described above, the sequence for the formation of the toner images is not restricted thereto so long as the colorless toner image 114S is formed in direct contact with the recording paper P. The sequence for the formation of the black toner image 114K, the magenta toner image 114M, the cyan toner image 114C, and the yellow toner image 114Y may be replaced with each other.

Second Exemplary Embodiment

Image Formation Apparatus and Image Forming Method

Figure 3:
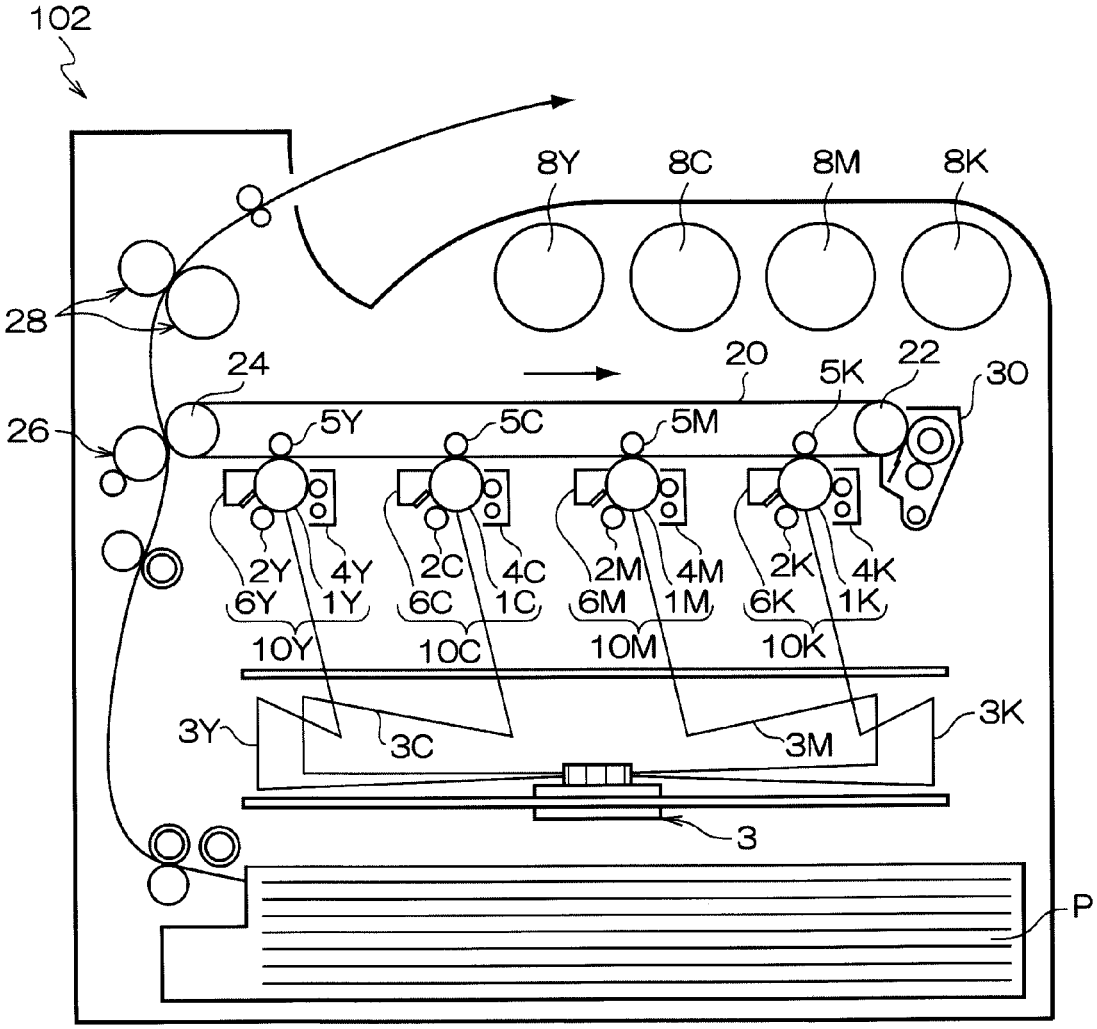
FIG. 3 is a schematic view illustrating an example of an image formation apparatus according to a second exemplary embodiment of the invention.

FIG. 3 is a schematic view illustrating an example of an image formation apparatus according to a second exemplary embodiment of the invention.

An image formation apparatus 102 according to the second exemplary embodiment is a 4-cassette tandem type color image formation apparatus as shown in FIG. 3. The image formation apparatus 102 according to the second exemplary embodiment does not use a colorless toner but uses a yellow toner as a toner for forming a contact toner image.

That is, the image formation apparatus 102 shown in FIG. 3 has the first to fourth units 10K, 10M, 10C, and 10Y, but does not have the fifth unit 10S, which is equipped to the image formation apparatus 101.

In the exemplary embodiment, the yellow toner image formed by the fourth unit 10Y is the contact toner image. The yellow toner image is formed in all of the regions on the surface of the recording paper P where the images are present. Accordingly, in every cases of forming images of any color in the exemplary embodiment, the yellow toner image is the contact toner image which is in direct contact with the recording paper P.

In the exemplary embodiment, the yellow toner has the smallest contact angle to the aqueous de-inking solution among the toners to be used.

That is, defining the contact angle of the yellow toner to the aqueous de-inking solution as $\theta_{12}$ (degree), the contact angle of the cyan toner to the aqueous de-inking solution as $\theta_{22}$ (degree), the contact angle of the magenta toner to the aqueous de-inking solution as $\theta_{23}$ (degree), and the contact angle of the black toner to the aqueous de-inking solution as $\theta_{24}$ (degree), all of relations of $\theta_{12}<\theta_{22}$, $\theta_{12}<\theta_{23}$, and $\theta_{12}<\theta_{24}$ are satisfied.

In the exemplary embodiment, in the image formation using all of the toners, the toner images transferred onto the surface of the intermediate transfer belt 20 are disposed in the sequence of the black toner image, the magenta toner image, the cyan toner image, and the yellow toner image from the image nearest to the intermediate transfer belt 20.

Further, the toner images transferred onto the recording paper P are disposed in the sequence of the yellow toner image, the cyan toner image, the magenta toner image, and the black toner image from the image nearest to the recording paper P.

That is, the yellow toner image is the contact toner image which is in direct contact with the recording paper P, and the cyan toner image, the magenta toner image, and the black toner image are non-contact toner images which are formed on the contact toner image and above the recording paper P with disposing the yellow toner image (contact toner image) between the recording paper P and the cyan toner image, the magenta toner image, and the black toner image.

Since the configuration of the image formation apparatus 102 is similar to that of the image formation apparatus 101 except for the difference described above, descriptions therefor are herein omitted.

In the image formation apparatus 102 of the exemplary embodiment, the contact angle of the yellow toner, which is the toner for forming a contact toner image, to the aqueous de-inking solution is smaller than the contact angles of any of the black toner, the magenta toner, and the cyan toner, which are the toners for forming non-contact toner images, to the aqueous de-inking solution.

In embodiments, in this exemplary embodiment, the value of $\theta_{22}$-$\theta_{12}$, the value of $\theta_{23}$-$\theta_{12}$, and the value of $\theta_{24}$-$\theta_{12}$ are respectively in the range of from about 2.5° to about 10°. When the values are within this range, de-inking property of an image formed thereby may be more excellent, and the deterioration in the image quality due to decrease of toner charge may be more effectively suppressed.

In embodiments, in the image formation apparatus 102 of the exemplary embodiment, a toner whose L* value is the largest among all of the toners to be used is used as the toner for forming the contact toner image. When the image formation apparatus 102 is configured as such, coloration due to a residual toner which may occur after the de-inking treatment may be suppressed.

While the conditions of the contact angles of the toners to the aqueous de-inking solution and the L* values of the toners in the CIE 1976 (L*a*b*) color system in the image formation apparatus 102 of the exemplary embodiment are set as explained above, the conditions of the contact angles of the toners to the aqueous de-inking solution and the L* values of the toners in the CIE 1976 (L*a*b*) color system are not limited to these, and may be varied as long as the contact angle of the yellow toner to the aqueous de-inking solution is smaller than any other toners.

While the image formation apparatus 102 of the exemplary embodiment has a configuration in which the intermediate transfer belt 20 is delivered to the units 10K, 10M, 10C, and 10Y in this sequence, the delivery sequence to units 10K, 10M, and 10C may be altered as long as the unit 10Y the last unit to which the belt is delivered.

Further, the sequence of the units 10K, 10M, 10C, and 10Y may be varied and the number of the types of the units may be increased or decreased, as long as the condition that the contact angle of the toner for forming the contact toner image to the aqueous de-inking solution is smaller than the contact angles of any other toners for forming non-contact toner images to the aqueous de-inking solution is satisfied.

Printed Item

FIG. 2 is a cross-sectional view illustrating an example of a printed item produced by the image formation apparatus according to the first exemplary embodiment of the invention.

A printed item produced by the image formation apparatus 102 using all the colors of the yellow toner, the cyan toner, the magenta toner, and the black toner has the recording paper P (recoding medium), a yellow toner image (contact toner image) which is formed in direct contact with the surface of the recording paper P, and a cyan toner image, a magenta toner image, and a black toner image (non-contact toner images) which are formed on the yellow toner image (contact toner image) and above the recording paper P with disposing the yellow toner image between the recording paper P and the cyan toner image, the magenta toner image, and the black toner image.

In the printed item of this exemplary embodiment, images are formed by using the image formation apparatus 102. Accordingly, among the contact angles of all toner images (the yellow toner image, the cyan toner image, the magenta toner image, and the black toner image) to the aqueous de-inking solution, the contact angle of the yellow toner image to the aqueous de-inking solution is the smallest.

Further, in the exemplary embodiment, the differences in the contact angle of the toner image to the aqueous de-inking solution (the value of $\theta_{22}-\theta_{12}$, the value of $\theta_{23}-\theta_{12}$, and the value of $\theta_{24}-\theta_{12}$) are similar to the difference in the contact angle of the toner to the aqueous de-inking solution. Accordingly, de-inking property and image quality of the printed item may be further improved.

Further, in the exemplary embodiment, the L* value of the toner image in the CIE 1976 (L*a*b*) color system is similar to the L* value of the toner described above. Accordingly, in the printed item of the exemplary embodiment, coloration by the residual toner after the de-inking treatment may be suppressed.

While the conditions of the contact angles of the toner images to the aqueous de-inking solution and the L* values of the toner images in the exemplary embodiment are set as explained above, the conditions of the contact angles of the toner images to the aqueous de-inking solution and the L* values of the toner images in the CIE 1976 (L*a*b*) color system are not limited to these, and may be varied as long as the contact angle of the yellow toner image to the aqueous de-inking solution is smaller than any other toner images.

While the toner images in the printed item of the exemplary embodiment are formed in the sequence described above, the sequence for the formation of the toner images is not restricted thereto so long as the yellow toner image is formed in direct contact with the recording paper P. The sequence for the formation of the black toner image, the magenta toner image, and the cyan toner image may be replaced with each other.

Further, in the printed item of the exemplary embodiment, the sequence of the toner images may be varied and the number of the types of the toner images may be increased or decreased, as long as the condition that the contact angle of the contact toner image, which is in direct contact with the recording medium P, to the aqueous de-inking solution is smaller than the contact angles of any other non-contact toner images to the aqueous de-inking solution is satisfied.

Third Exemplary Embodiment

Image Formation Apparatus and Image Forming Method

Figure 4:
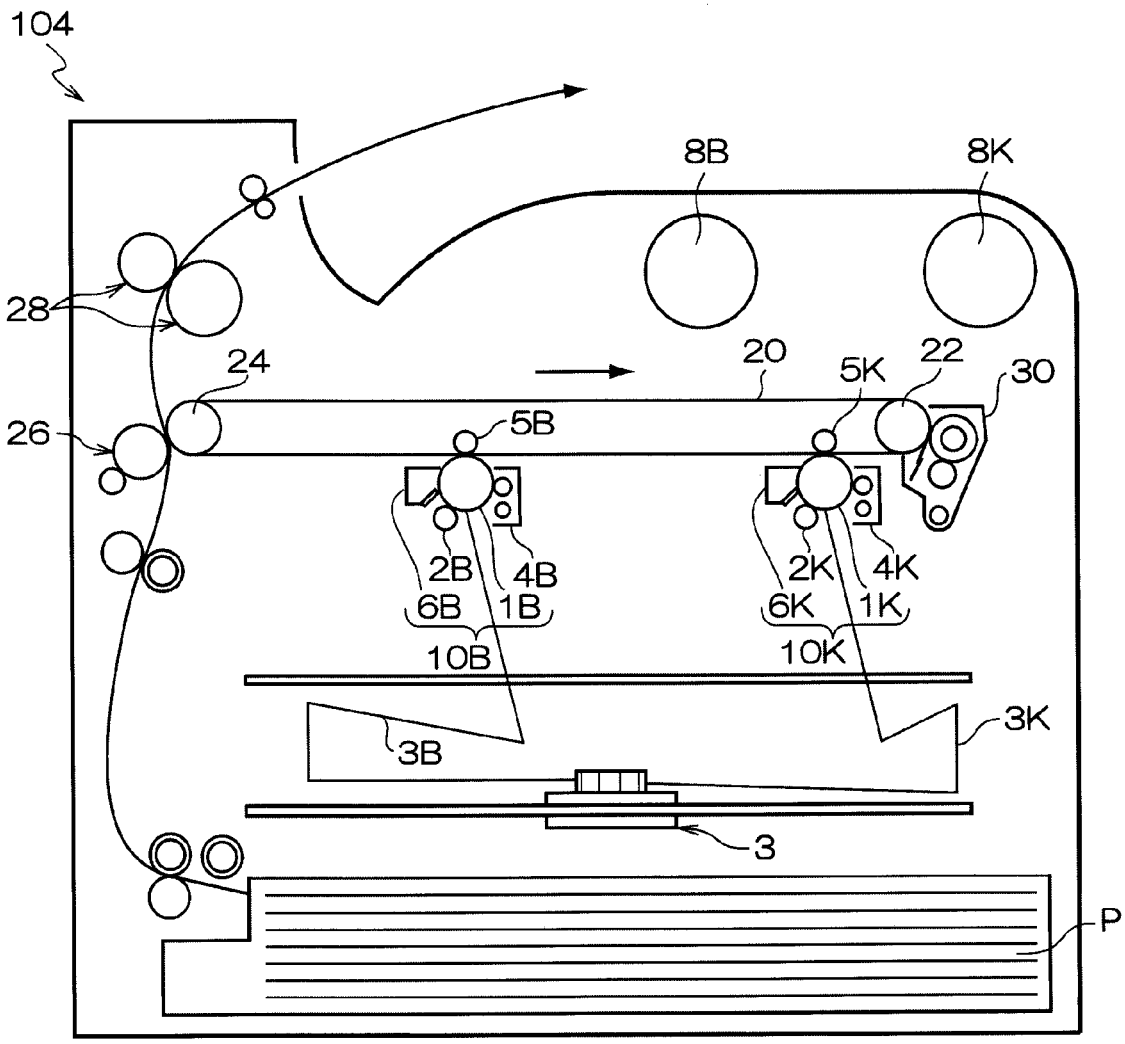
FIG. 4 is a schematic view illustrating an example of an image formation apparatus according to a third exemplary embodiment of the invention.

FIG. 4 is a schematic view illustrating an example of an image formation apparatus according to a third exemplary embodiment of the invention.

An image formation apparatus 104 according to the third exemplary embodiment is a monochromatic image formation apparatus as shown in FIG. 4. The image formation apparatus 104 according to the third exemplary embodiment uses two types of black toners which are of the same color and different in the contact angle to the aqueous de-inking solution. Specifically, a black toner of a smaller contact angle to the aqueous de-inking solution (second black toner) is used as the toner for forming a contact toner image, and a black toner of a larger contact angle to the aqueous de-inking solution (first black toner) is used as a toner for forming the non-contact toner image.

The image formation apparatus 104 shown in FIG. 4 has a configuration including a first unit 10K and a second unit 10B for forming black images over the entire image region.

In the exemplary embodiment, the second black toner image formed by the second unit 10B is a contact toner image. Further, the first black toner image formed by the first unit 10K is a non-contact toner image.

In the exemplary embodiment, the contact angle of the second black toner used for forming the second black toner image to the aqueous de-inking solution is smaller than the contact angle of the first black toner used for forming the first black toner image to the aqueous de-inking solution. That is, defining the contact angle of the second black toner to the aqueous de-inking solution as $\theta_{13}$ (degree), and the contact angle of the first black toner to the aqueous de-inking solution as $\theta_{24}$ (degree), the relation of the contact angles is $\theta_{13}<\theta_{24}$.

In the exemplary embodiment, in the image formation using all of the toners, the toner images transferred onto the surface of the intermediate transfer belt 20 are disposed in the sequence of the first black toner image and the second black toner image from the image neareat to the intermediate transfer belt 20.

Further, the toner images transferred onto the recording paper P are disposed in the sequence of the second black toner image and the first black toner image from the image nearest to the recording paper P.

Since the configuration of the image formation apparatus 104 is similar to that of the image formation apparatus 101 except for the difference described above, descriptions therefor are herein omitted.

In the image formation apparatus 104 of the exemplary embodiment, the contact angle of the second black toner, which is the toner for forming a contact toner image, to the aqueous de-inking solution is smaller than the contact angle of the first black toner, which is the toner for forming non-contact toner image, to the aqueous de-inking solution.

In embodiments, in this exemplary embodiment, the value of $\theta_{24}-\theta_{13}$ is in the range of from about 2.5° to about 10°. When the value is within this range, de-inking property of an image formed thereby may be more excellent, and the deterioration in the image quality due to decrease of toner charge may be more effectively suppressed.

In the image formation apparatus 104 of the exemplary embodiment, two types of toners of the same color (black) are used, but the color of the toners is not restricted thereto. The color for the toner may be selected in accordance with the color of the image to be formed. Further, the color of the two types of toner may be different. Specific examples thereof include those of using a colorless toner as the toner for forming a contact toner image and using a black toner as the toner for forming the non-contact toner image.

Printed Item

A printed item produced by the image formation apparatus 104 according to the third exemplary embodiment of the invention has the recording paper P (recoding medium), a second black toner image (contact toner image) which is formed in direct contact with the surface of the recording paper P, and a first black toner image (non-contact toner image) which is formed on the second black toner image (contact toner image) and above the recording paper P with disposing the second black toner image between the recording paper P and the first black toner image.

In the printed item of this exemplary embodiment, images are formed by using the image formation apparatus 104. Accordingly, the contact angle of the second black toner image to the aqueous de-inking solution is smaller than the contact angle of the first black toner image to the aqueous de-inking solution.

Further, in the exemplary embodiment, the difference in the contact angle of the toner image to the aqueous de-inking solution (the value of $\theta_{24}-\theta_{13}$) is in the range of from about 2.5° to about 10°. Accordingly, de-inking property and image quality of the printed item may be further improved.

While each of the contact toner image and the non-contact toner image is the black toner image in the printed item of the exemplary embodiment, it is not restricted only thereto so long as the contact angle of the contact toner image and that of the non-contact toner image to the aqueous de-inking solution satisfy the relation, and the color for the toner images may be selected in accordance with the color image to be formed. Specifically, for example, both of the contact toner image and the non-contact toner image may be respectively a cyan toner image, or the contact toner image may be a colorless toner image whereas the non-contact toner image may be a black toner image.

Toner

The toner used in the exemplary embodiments contains at least a binder resin, and may further contain a colorant, a release agent, and/or other components.

Binder Resin

There is no particular limitation to the binder resin. Examples of the binder resin include: a homopolymer of any one of or a copolymer of any of monomers such as styrenes such as styrene, parachlorostyrene, or α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate lauryl methacrylate or 2-ethylhexyl methacrylate; vinylnitriles such as acrylonitrile or methacrylonitrile; vinyl ethers such as vinyl methyl ether or vinyl isobutyl ether; vinyl ketones such as vinyl methyl ketone, vinyl ethyl ketone or vinyl isopropenyl ketone; polyolefins such as ethylene, propylene or butadiene; and a mixture of the homopolymer and/or the copolymer.

Examples of the binder resin further include an epoxy resin, a polyester resin, a polyurethane resin, a polyamide resin, a cellulose resin, a polyether resin, and a non-vinyl condensed resin, and a mixture of any of these with the vinyl resin, and a graft polymer obtained by polymerizing a vinyl monomer in the presence of these.

The styrene resin, the (meth)acrylic resin, and the styrene-(meth)acrylic copolymer resin may be prepared, for example, by a known method using one or a combination of plural of the following styrene monomers or (meth)acrylic monomers.

Specific examples of the styrene monomer include styrene, α-methylstyrene, vinylnaphthalene, an alkyl substituted styrene having an alkyl chain such as 2-methylstyrene, 3-methylstyrene, 4-methylstyrene, 2-ethylstyrene, 3-ethylstyrene, or 4-ethylstyrene, a halogen-substituted styrene such as 2-chlorostyrene, 3-chlorostyrene, or 4-chlorostyrene, and a fluoro-substituted styrene such as 4-fluorostyrene or 2,5-difluorostyrene. Specific examples of the (meth)acrylic acid monomer include (meth)acrylic acid, n-methyl(meth)acrylate, n-ethyl(meth)acrylate, n-propyl(meth)acrylate, n-butyl (meth)acrylate, n-pentyl(meth)acrylate, n-hexyl(meth)acrylate, n-heptyl(meth)acrylate, n-octyl(meth)acrylate, n-decyl (meth)acrylate, n-dodecyl(meth)acrylate, n-lauryl(meth) acrylate, n-tetradecyl(meth)acrylate, n-hexadecyl(meth) acrylate, n-octadecyl(meth)acrylate, isopropyl(meth) acrylate, isobutyl(meth)acrylate, t-butyl(meth)acrylate, isopentyl(meth)acrylate, amyl(meth)acrylate, neopentyl (meth)acrylate, isohexyl(meth)acrylate, isoheptyl(meth) acrylate, isooctyl(meth)acrylate, 2-ethylhexyl(meth)acrylate, phenyl(meth)acrylate, biphenyl(meth)acrylate, diphenylethyl(meth)acrylate, t-butylphenyl(meth)acrylate, terphenyl(meth)acrylate, cyclohexyl(meth)acrylate, t-butylcyclohexyl(meth)acrylate, dimethylaminoethyl(meth)acrylate, diethylaminoethyl(meth)acrylate, methoxyethyl(meth) acrylate, 2-hydroxyethyl(meth)acrylate, β-carboxyethyl (meth)acrylate, (meth)acrylonitrile, and (meth)acrylamide.

In a case of using the styrene resin, the (meth)acrylic resin, and/or the copolymer resin thereof as the binder resin, these resins may have a weight average molecular weight Mw of from about 20,000 to about 100,000, and a number average molecular weight Mn of from about 2,000 to about 30,000. On the other hand, in a case of using the polyester resin as the binder resin, these resins may have a weight average molecular weight Mw of from about 5,000 to about 40,000, and the number average molecular weight Mn of from about 2,000 to about 10,000.

In embodiments, the glass transition temperature of the styrene resin, (meth)acrylic resin, and a copolymer resin thereof is in the range of from 40° C. or higher and 80° C. or lower. When the glass transition temperature is in this range, the heat resistant blocking property and the minimum fixing temperature of the toner may be maintained.

Examples of the polyester resin include a crystalline polyester resin and a non-crystalline polyester resin, which may be those synthesized from a polyvalent carboxyl acid component and a polyhydric alcohol component. Either or both of a commercially available product and a resin obtained by synthesis may be appropriately used as the polyester resin.

Herein, the "crystalline polyester resin" indicates a polyester which does not reveal a stepwise change in an endothermic amount, but reveals a clear endothermic peak in differential scanning calorimetry (DSC). In contrast, a polyester which reveals a stepwise change in an endothermic amount in DSC is the "non-crystalline polyester resin".

Examples of the polyvalent carboxylic acids include aliphatic dicarboxylic acids such as oxalic acid, succinic acid, fumaric acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, or 1,18-octadecanedicarboxylic acid; aromatic dicarboxylic acids such as diprotic acids such as phthalic acid, isophthalic acid, terephthalic acid, naphthalene-2,6-dicarboxylic acid, malonic acid, or mesaconic acid; alicyclic carboxylic acids such as cyclohexane dicarboxylic acid; and an anhydride or a lower alkyl ester thereof.

Examples of a tri- or more-valent carboxylic acid include 1,2,4-benzenetricarboxylic acid, 1,2,5-benzenetricarboxylic acid, 1,2,4-naphthalenetricarboxylic acid, and an anhydride or a lower alkyl ester thereof. These may be used alone, or two or more kinds may be used in combination.

In addition to the aliphatic dicarboxylic acids and aromatic dicarboxylic acids, dicarboxylic acid component having a double bond may be contained as an acid component. The dicarboxylic acid having a double bond may be preferably used for preventing hot offset at fixation that it may be bound in a radical cross-linking manner via its double bond. Examples of the dicarboxylic acid include maleic acid, fumaric acid, 3-hexenedioic acid, and 3-octenedioic acid. Examples thereof further include a lower ester and an acid anhydride thereof. Among them, fumaric acid and maleic acid may be specifically employed from a viewpoint of a cost.

Examples of the polyhydric alcohol component include aliphatic diols such as ethylene glycol, diethylene glycol, triethylene glycol, propylene glycol, butanediol, hexanediol, neopentyl glycol or glycerin, alicyclic diols such as cyclohexanediol, cyclohexane dimethanol or hydrogenated bisphenol A, and aromatic diols such as ethylene oxide adduct of bisphenol A or propylene oxide adduct of bisphenol A. One of these polyhydric alcohols may be used alone or two or more of them may be used together.

Among the polyhydric alcohol components, an aromatic diol and an alicyclic diol are preferable, and an aromatic diol is more preferable as the polyhydric alcohol component for forming the non-crystalline polyester resin. On the other hand, an aliphatic diol is preferable, and a straight-chained aliphatic diol having a carbon number of 7 to 20 in a main chain part thereof may be more preferable as the polyhydric alcohol component for forming the crystalline polyester resin. When the aliphatic diol is a branched chained aliphatic diol, crystallizability of the polyester resin may be reduced, and a fusing temperature of the polyester resin may be lowered, which may result in deterioration in toner blocking resistance, image retainability, and low temperature fixability in some cases. When the carbon number is less than 7 a melting point of the polyester resin may be elevated when the alcohol component is polycondensed with aromatic dicarboxylic acid, which may result in difficulty in low temperature fixation in some cases. On the other hand, when the carbon number exceeds 20, it tends to be difficult to obtain practically-usable materials. In embodiments, the carbon number may be 14 or less.

Examples of the aliphatic diol which may be used in synthesis of crystalline polyester resin include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, and 1,18-octadecanediol. Among them, in view of easiness in availability, 1,8-octanediol, 1,9-nonanediol, and 1,10-decanediol are preferable.

Examples of a tri- or more-hydric alcohol include glycerin, trimethylolethane, trimethylolpropane, and pentaerythritol. These may be used alone, or two or more kinds may be used in combination.

A content of the aliphatic diol component is preferably 80 mole % or more, and more preferably 90 mole % or more, with respect to the polyhydric alcohol component to be used for synthesis of the crystalline polyester resin. When the content of the aliphatic diol component is less than 80 mole %, toner blocking resistance, image retainability, low temperature fixability may be deteriorated in some cases due to reduction in crystallizability of the polyester resin and lowering of a fusing temperature of the polyester resin.

If necessary, a monovalent acid such as acetic acid or benzoic acid, and/or a monohydric alcohol such as cyclohexanol or benzyl alcohol may be used for the purpose of adjusting an acid value or a hydroxyl group value of the polyester resin.

The polyester resin ma be prepared by condensation reaction of the polyhydric alcohol and the polyvalent carboxylic acid in accordance with a customary method. For example, the polyester resin is prepared by: blending the polyhydric alcohol and the polyvalent carboxylic acid in a reaction vessel having a thermometer, a stirrer, a flow down condenser, optionally further adding a catalyst thereto; heating them at 150° C. to 250° C. in the presence of an inert gas (nitrogen gas, etc.) with continuously removing by-produced low molecular compounds to the outside of the reaction system; terminating the reaction at the instance reaching an aimed acid value; and cooling them to recover the aimed reaction products.

Examples of the catalyst used for the synthesis of the polyester resin include estefifying catalysts such as an organic metal such as dibutyltin dilaurate or dibutyltin oxide, or a metal alkoxide such as tetrabutyl titanate. The addition amount of the catalyst may be from 0.01 mass % to 1 mass % based on the total amount of the starting materials.

For the molecular weight of the non-crystalline polyester resin used for the toner by the measurement of the molecular weight according to the gel permeation chromatography (GPC) for the tetrahydrofuran (THF) soluble component, a weight average molecular weight (Mw) is, preferably, in the range of from 5000 to 200000, and more preferably, in the range of from 7000 to 100000, a number average molecular weight (Mn) is preferably in the range of from 2000 to 10000, and a molecular weight distribution Mw/Mn is preferably in the range of from 1.5 to 50 and more preferably in the range of from 2 to 10.

The weight average molecular weight (Mw) of the crystalline polyester resin is preferably in the range of from 5000 to 70000, and more preferably in the range of from 15000 to 50000. The number average molecular weight (Mn) of the crystalline polyester resin is preferably, in the range of from 2000 to 20000. The molecular weight distribution Mw/Mn of the crystalline polyester resin is preferably in the range from 1.5 to 10, and more preferably in the range of from 2.0 to 4.0.

When the weight average molecular weight and the number average molecular weight are smaller than the ranges, the low temperature fixability may be improved, whereas the anti-hot offset property may be deteriorated as well as an undesired effect on the storability such as blocking of the toner may be caused since glass transfer temperature of the toner may be lowered thereby. On the other hand, when the molecular weight is more than the range, while the anti-hot offset property may be provided sufficiently, the low temperature fixability may be deteriorated, as well as an undesired effect on the document storability may be caused since bleeding of the crystalline polyester phase present in the toner may be suppressed thereby. When the conditions are satisfied, the low temperature fixability, the anti-offset property, and the document storability may be easily achieved.

The molecular weights and the molecular-weight distributions of the toner for developing electrostatic latent images and the resin microparticleparticle according to the inventions may be determined by gel-permeation chromatography (GPC). The GPC apparatus used is HLC-8120 GPC, SC-8020 (trade name, manufactured by Tosoh Corp.) equipped with two columns, TSK GEL SUPER HM-H (trade name, manufactured by Tosoh Corp., 6.0 mm ID×15 cm), in which tetrahydrofuran (THF) is used as the eluent. In each experiment, the sample concentration is 0.5% by weight, the flow rate is 0.6 ml/min, the sample injection is 10 μl, and the measuring temperature is 40° C. An IR detector is used for measurement. The calibration curve is prepared based on the data obtained using 10 polystyrene standard samples of "TSK STANDARDS" of "A-500", "F-1", "F-10", "F-80", "F-380", "A-2500", "F-4", "F-40" "F-128", and "F-700", manufactured by Tosoh Corp.

In embodiments, the acid value of the polyester resin (the amount by mg of KOH necessary for neutralizing 1 g of a resin) may be 1 mg KOH/g to 30 mg KOH/g on the grounds that the aforementioned molecular weight distribution is easily obtained, granulating property of toner particles in an emulsion dispersing method is easily maintained, and a favorable environmental stability of the obtained toner (stability in electrifying property when a temperature or a humidity changes) is easily maintained. The acid value of the polyester resin may be adjusted by controlling a carboxyl group at the end of the polyester, i.e. adjusting a blending ratio and a reaction rate of polyvalent carboxylic acid and a polyhydric alcohol in the raw material. Alternatively, a polyester having a carboxyl group in its main chain may be obtained by using trimellitic anhydride as a polyvalent carboxylic acid component.

In embodiments, the glass transition temperature of the non-crystalline polyester resin may be 35° C. to 100° C., and in embodiments it may be 50° C. to 80° C. from a viewpoint of the balance between storage stability and fixability of a toner. When the glass transition temperature is lower than 35° C., there is a tendency that the toner easily causes blocking (a phenomenon that toner particles aggregate to form a mass) during storage or in a developing machine. On the other hand, when the glass transition temperature exceeds 100° C., a fixing temperature of the toner may become too high.

In embodiments, a fusing temperature of the crystalline polyester resin is in the range of 60° C. to 120° C., and in embodiments, the fusing temperature is in the range of 70° C. to 100° C. When the fusing temperature is lower than 60° C., powdery materials in the toner may easily aggregate and/or stability of fixed images formed from the toner may be deteriorated. When the fusing temperature is higher than 120° C., image quality and low-temperature fixability may be deteriorated.

Herein, the temperature at which the endothermic peak is revealed in the DSC is determined as the fusing temperature of the crystalline polyester resin.

Colorant

The colorant is not particularly restricted so long as it is a known colorant. Examples thereof include a carbon black such as furnace black, channel black, acetylene black, or thermal black, an inorganic pigment such as red iron oxide, ultramarine blue, or titanium oxide, an azo pigment such as fast yellow, disazo yellow, pyrazolone red, chelate red, brilliant carmine, or parabrown; a phthalocyanine pigment such as copper phthalocyanine or non-metal phthalocyanine; and a coalesced polycyclic pigment such as flavanthrone yellow, dibromo anthrone orange, perylene red, quinacrydone red, or dioxadine violet.

Specifically, various pigments may be illustrated including, for example, chrome yellow, hansa yellow, benzidine yellow, threne yellow, quinoline yellow, permanent orange GTR, pyrazolone orange, Vulcan orange, watch young red, permanent red, dupont oil red, lithol red, rhodamine B lake, lake red C, rose Bengal, aniline blue, ultramarine blue, Calco Oil blue, methylene blue chloride, phthalocyanine blue, phthalocyanine green, malachite green oxalate, C.I. pigment red 48:1, C.I. pigment red 122, C.I. pigment red 57:1, C.I. pigment yellow 12, C.I. pigment yellow 97, C.I. pigment yellow 17, C.I. pigment blue 15:1, and C.I. pigment blue 15:3. They may be used alone, or two or more of them may be used in combination.

The content of the colorant in the toner for development of an electrostatic latent image in this exemplary embodiment may be in the range of about 1 to about 30 parts by weight based on 100 parts by weight of the binder resin. It may be also effective to use a colorant whose surface is treated as necessary, or a pigment dispersant. By selecting the type of the colorant, a yellow toner, magenta toner, cyan toner, black toner or the like may be obtained.

On the other hand, the colorless toner contains substantially no colorant.

Release Agent

The release agent is not particularly restricted so long as it is a known release agent and includes, for example, a natural wax such as calnauba wax, rice wax, or candellila wax; a synthetic, mineral, or petroleum wax such as low molecular weight polypropylene, low molecular weight polyethylene, sasol wax, microcrystalline wax, Fischer-Tropsch wax, paraffin wax, or montan wax; and an ester type wax such as a fatty acid ester, or a montanoic acid ester but they are not limitative. Further, these release agent may be used each alone or two or more of them may be used in combination.

The melting temperature of the release agent is preferably 50° C. or higher, and more preferably 60° C. or higher with a view point of storability. Further, with a view point of the anti-offset property, it is preferably 110° C. or lower, and more preferably 100° C. or lower.

The content of the release agent is preferably in the range of from 2 parts by mass to 30 parts by mass, and more preferably in the range of from 3 parts by mass to 20 parts by mass based on 100 parts by mass of the binder resin. In a case where the content of the release agent is less than 2 parts by mass, there may be no effect of adding the release agent, and hot offset (a phenomenon that a toner is deposited to a heated surface due to decrease of the cohesive force of the toner caused by heating the entire of the toner to a high temperature) may occur at a high temperature (for example, 190° C.). On the other hand, in a case where it exceeds 30 parts by mass, the chargeability of the toner may be undesirably affected, and the mechanical strength of the toner may tend to be lowered, by which the toner may be liable to be broken by the stress in a developing device to sometimes bring about carrier contamination or the like.

Other Component

The toner of the exemplary embodiment may further contain various components such as an internal additive, a charge controlling agent, an inorganic particulate matter (inorganic particle), and an organic particles as necessary.

Examples of the internal additive include a magnetic material such as a ferrite, a magnetite, a metal such as reduced iron, cobalt, nickel, or manganese, an alloy, and a compound containing the metal.

In a case of incorporating the magnetic material or the like to use the toner as a magnetic toner, the average particle size of the magnetic material is preferably 2 μm or less, and more preferably from 0.1 μm to 0.5 μm. The content of the magnetic material to be incorporated in the toner is preferably from 20 parts by mass to 200 parts by mass, and more preferably from 40 parts by mass to 150 parts by mass, based on 100 parts by mass of the resin component. Further, the magnetic material preferably has a coercivity (Hc) from 20 oersted to 300 oersted, a saturation magnetization (σs) from 50 emu/g to 200 emu/g, and a remnant magnetization (σr) of 2 emu/g to 20 emu/g as the magnetic properties under the application of 10 K oersted.

Examples of the charge control ling agent include dyes such as a quaternary ammonium salt compound, a nigrosine compound, or a complex including aluminum, iron or chromium, and a tripheylmethane pigment.

The inorganic particle may be contained in the toner for various purposes and may be included for regulation of the viscoelasticity of the toner. Examples of the inorganic particles include known inorganic particles such as silica particles, alumina particles, titanium oxide particles, calcium carbonate particles, magnesium carbonate particles, calcium phosphate particles, cerium oxide particles, and any other inorganic particles which may be used as external additives for a toner surface.

Examples of an inorganic particle and an organic particle which may be added externally to the toner are as follows.

Examples of the inorganic particle include particles of silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. In embodiments, silica particle and titanium oxide particle are preferable, and hydrophobilized particles are particularly preferable.

The inorganic particle may be added externally to colored particles for the purpose of improving flowability of the toner. In embodiments, the primary diameter of the inorganic particle may be in the range of about 1 nm to about 200 nm. In embodiments, the content of the inorganic particle may be in the range of about 0.01 to about 20 parts by weight with respect to the total mass of the toner.

The organic particle is generally used for improving the cleaning property, the transferring property and the like. Specific examples thereof includes a powder of a fluoro resin such as of polyvinylidene fluoride or polytetrafluoroethylene, a fatty acid metal salt such as zinc stearate or calcium stearate, polystyrene, and polymethyl methacrylate.

Manufacturing Method of Toner

As a manufacturing method of the electrophotographic toner according to the invention, a kneading pulverizing method and a wet granulation method may be used. The wet granulation method may be desirable. Examples of the wet granulation method include known methods such as a melt suspension method, emulsion aggregation method or dissolution suspension method. Among these, the emulsion aggregation method may be preferably used.

The emulsion aggregation method includes at least: emulsifying each of starting materials such as a polyester resin and a colorant by dispersing these in an aqueous dispersion medium; aggregating the dispersed components in a liquid dispersion of the starting material obtained by mixing each of the liquid dispersions to prepare aggregated particles; and coalescing the aggregated particles by heating to obtain a toner. The emulsion aggregation method may further include coating the surface of the aggregated particle with particles of a resin which is the same as or different from the binder resin (shell layer forming).

Each of the processes of the manufacturing method is described below in detail.

Emulsification

In the emulsion aggregation method, since the binder resin and the colorant are mixed as respective emulsified particles as the liquid dispersion of starting material, the emulsifying is a step of preparing the emulsified liquid dispersion of the starting materials. Accordingly, it is necessary that the binder resin is dispersed in advance as resin particles in the liquid dispersion of the starting material.

The volume average particle size of the emulsified resin particles is preferably from 0.01 μm to 1 μm, more preferably from 0.03 μm to 0.8 μm, and further preferably from 0.03 μm to 0.6 μm. In a case where the average particle size exceeds 1 μm, the particle size distribution of the finally obtained toner for developing electrostatic latent image may be broader, and free particles may be generated to cause deterioration in the performance, the reliability and the like. On the other hand, in a case where the average particle size is within the range, such drawbacks may not be caused, and compositional deviation between the toner particles may be decreased, dispersing of the toner particles may be improved, and irregularity in the performance or the reliability of the toner may be decreased. The volume average particle size may be measured by using a coulter counter method, a photon correlation spectroscopy, a laser diffraction-scattering method, a white light polarization method, or the like.

Examples of a dispersing medium include an aqueous medium. Examples of the aqueous medium include distilled water, and ion exchanged water, and alcohols. These may be used alone, or two or more kinds may be used in combination. A surfactant may be added to and mixed with the aqueous medium. There is no particular limitation to the surfactant. Examples of the surfactant include anionic surfactants such as a sulfate ester salt, a sulfonate salt, a phosphate salt, or a soap; cationic surfactants such as an amine salt or a quaternary ammonium salt; nonionic surfactants such as a polyethylene glycol, an alkylphenol ethylene oxide adduct, or a polyhydric alcohol. Among them anionic surfactants and cationic surfactants are more preferable. The nonionic surfactant may be used in combination with the anionic surfactant or the cationic surfactant. The surfactant may be used singly or in combination of two or more thereof.

Specific examples of the anionic surfactant include sodium dodecylbenzenesulfonate, sodium dodecyl sulfate, sodium alkylnaphthalene sulfonate, and sodium dialkylsulfo succinate. Specific examples of the cationic surfactant include alkylbenzenedimethylammonium chloride, alkyltrimethylammonium chloride, and distearyllammonium chloride.

For example, in a case of using a polyester resin as the binder resin, the polyester resin may be a self-water dispersible polyester resin containing a functional group that may be in an anionic form by neutralization. An aqueous dispersion which is stable under the effect of an aqueous medium may be formed by neutralizing a part or all of the functional group that may be in an anionic form with a base.

Examples of the functional group in the polyester resin that may be in an anionic form by neutralization include an acidic group such as a carboxyl group or a sulfonic group, and examples of the neutralizing agent include an inorganic base such as sodium hydroxide, potassium hydroxide, lithium hydroxide, calcium hydroxide, sodium carbonate, or ammonia, and an organic base such as diethyl amine, triethyl amine, or isopropyl amine.

In a case of using a polyester resin which is not dispersed per se in water, that is, a polyester resin which has no self-water dispersibility as the binder resin, an ionic surfactant or a polymeric electrolyte such as a polymer acid or a high molecular salt may be added to a resin solution and/or an aqueous medium to be mixed with the resin solution, and the resultant may be dispersed, heated to a temperature higher than the melting temperature, and then may be treated with a homogenizer or a pressure discharge type disperser which apply a strong shearing force. With such a treatment, the resin may be easily dispersed into particles with a diameter of 0.5 μm or less. In a case of using the ionic surfactant or the polymeric electrolyte, the concentration thereof in the aqueous medium may be appropriately from 0.5 to 5 mass %. The release agent described below may be treated in a manner pursuant thereto.

Examples of the method of dispersing the polyester resin further include a phase inversion emulsification method. The phase inversion emulsification method is a method including dissolving a resin to be dispersed in a hydrophobic organic solvent in which the resin is soluble, neutralizing the same by adding a base to a continuous organic phase (O phase) and then charging an aqueous medium (W phase), thereby inverting the resin from W/O to O/W (so-called phase inversion) into a discontinuous phase, and stabilizing the resin in a form of particulate dispersed in an aqueous medium.

Examples of the organic solvent used for the phase inversion emulsification include an alcohol such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol, or cyclohexanol, a ketone such as methyl ethyl ketone, methyl isobutyl ketone, ethyl butyl ketone, cyclohexanone, or isophorone, an ether such as tetrahydrofuran, dimethyl ether, diethyl ether, or dioxane, an ester such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate, or dimethyl carbonate, a glycol compound such as ethylene glycol, ethylene golycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate, or dipropylene glycol monobutyl ether, and further, 3-methoxy-3-methyl butanol, 3-methoxybutanol, acetonitrile, dimethyl formamide, dimethyl acetamide, diacetone alcohol, and ethyl acetoacetate. The solvents may be used each alone or two or more of them may be used in combination.

In the phase inversion emulsification, carboxyl groups in the resin may be partially or entirely neutralized with a neutralizing agent if necessary when the binder resin is dispersed in water. Examples of the neutralizing agent include an inorganic alkali such as potassium hydroxide or sodium hydroxide, an amine such as ammonia, monomethylamine, dimethylamine, triethylamine, monoethylamine, diethylamine, triethylamine, mono-n-propylamine, dimethyl-n-propylamine, monoethanolamine, diethanolamine, triethanolamine, N-methylethanolamine, N-aminoethyl ethanolamine, N-methyldiethanolamine, monoisopropanolamine, diisopropanolamine, triisopropanolamine, or N,N-dimethylpropanolamine. One or more of them selected therefrom may be used. By adding the neutralizing agent, pH may be adjusted upon emulsification to a neutral region thereby suppressing hydrolysis of the obtained liquid dispersion of the polyester resin.

A dispersing agent may be employed in the phase inversion emulsification in view of stabilization of the dispersed resin particles and suppression of increase of viscosity. Examples of the dispersing agent include: water-soluble polymers such as polyvinyl alcohol, methyl cellulose, ethyl cellulose, hydroxyethyl cellulose, carboxymethyl cellulose, polysodium acrylate or polysodium methacrylate; surfactants such as anionic surfactants such as sodium dodecylbenzenesulfonate, sodium octadecylsulfate, sodium oleate, sodium laurate or potassium stearate; cationic surfactants such as laurylamine acetate, stearylamine acetate or lauryltrimethylammonium chloride; amphoteric surfactants such as lauryldimethylamine oxide; nonionic surfactants such as polyoxyethylene alkyl ether, polyoxyethylene alkylphenylether or polyoxyethylene alkylamine; and inorganic compounds such as tripotassium phosphate, aluminum hydroxide, calcium sulfate, calcium carbonate or barium carbonate. These dispersing agents may be respectively used singly or in combination of two or more thereof. The amount of the dispersing agent to be added in the phase inversion emulsification may be in the range of from 0.01 parts by mass to 20 parts by mass with respect to 100 parts by mass of the binder resin.

The emulsification temperature during the phase inversion emulsification may be a boiling temperature of the organic solvent or lower and a melting temperature (or transition temperature) of the release agent or higher. In a case where the emulsification temperature is not higher than the melting temperature or the transition temperature of the release agent, a liquid dispersion of particles containing the release agent may not be obtained. In a case of emulsification at a boiling temperature of the organic solvent or higher, emulsification may be carried out in a device tightly closed under a pressure.

The colorant described above may be used as a colorant in the liquid dispersion of the starting material and dispersed by the emulsification.

Any generally-known dispersion method such as a rotary shear homogenizer, or a ball mill, a sand mill, or a dynomill having media may be used as the method of dispersing the colorant with no particular restriction. If necessary, a surfactant may be used for preparing an aqueous dispersion of the colorant, or a dispersant may be used for preparing a liquid dispersion of the colorant in an organic solvent. The liquid dispersion of the colorant may be referred to as "liquid dispersion of colored particles". The surfactant and the dispersant used for dispersing the colored particles may be similar to the dispersant that may be used upon dispersing the binder resin.

The addition amount of the colorant is preferably from 1 to 20 mass %, more preferably from 1 to 10 mass %, further preferably from 2 to 10 mass % and, particularly preferably from 2 to 7 mass % based on the total amount of the resin. A larger addition amount may be employed within these ranges as long as the image surface is not roughened after image fixation. As the content of the colorant is increased, the thickness of the image may be decreased upon forming an image at an identical level of concentration, which may facilitate to prevent offset.

The colorant may be added to the solvent to be mixed all at once together with other particle ingredients, or may be divided into plural portions and respectively added at plural stages.

The release agent explained above is used as a release agent in the liquid dispersion of the starting material to be dispersed by the emulsifying.

Similarly to the dispersing of the polyester resin not having self-water dispersibility by emulsification, the release agent is dispersed in water together with an ionic surfactant, heated to its melting temperature or higher, and conditioned to have a dispersion particle diameter of 1 μm or less by using a homogenizer or a pressure discharge type dispersing machine which apply intense shear force. Examples of the dispersion medium used in the liquid dispersion of release agent are similar to those of the dispersion medium for the binder resin.

Examples of the apparatus for mixing the binder resin and the colorant with the aqueous medium and dispersing them by emulsification include continuous emulsifying-dispersing machines such as a HOMOMIXER (trade name, manufactured by Tokushu Kika Kogyo Co., Ltd.), SLASHER (trade name, manufactured by Mitsui Mining Co., Ltd.), CAVITRON (trade name, manufactured by Euroteche Co., Ltd.), MICROFLUIDIZER (trade name, manufactured by Mizuho Industrial Co., Ltd.), MONTON-GAULIN HOMOGENIZER (trade name, manufactured by Gualin Inc.), NANOMIZER (trade name, manufactured by Nanomizer Inc.), and STATIC MIXER (trade name, manufactured by Noritake Co., Ltd.).

The content of the resin particles contained in the liquid dispersion of the binder resin (liquid dispersion of resin particles), the content of the colorant in the liquid dispersion of the colorant (liquid dispersion of colored particles), and the content of the release agent in the liquid dispersion of the release agent (liquid dispersion of releasing particles) in the emulsifying are respectively preferably from 5 mass % to 50 mass %, and more preferably from 10 mass % to 40 mass %. In a case where the content is out of the range, the particle size distribution may be broader, which may lead to inferior toner property.

Depending on the purpose, other ingredients such as the internal additive, the charge controlling agent, or the inorganic powder may also be dispersed in the liquid dispersion of the binder resin.

The charge controlling agent may be those formed of materials less soluble in water with a view point of regulating the ionic strength which affect the stability of dispersions in the aggregating or the coalescing and reducing contamination degree of waste water.

The average particle size of the other ingredients is preferably 1 μm or less, and more preferably from 0.01 μm to 0.5 μm. In a case where the average particle size exceeds 1 μm, the particle size distribution of the finally obtained toner may be broader, or free particles may be generated to decrease the performance and the reliability. On the other hand, in a case where the average particle size is within the range, the drawbacks described above may not occur, compositional deviation between the toner particles may decreased, and the dispersion in the toner may be enhanced to reduce the irregularities in the performance or the reliability.

Aggregating

In the aggregating, the liquid dispersions of the resin particles and the colorant obtained in the emulsifying are mixed with each other (the liquid mixture is referred to as "liquid dispersion of starting material") and heated to a temperature, for example, of 50° C. or lower to form aggregated particles in which the respective dispersed particles aggregate.

Before the aggregating, a high acid value-dispersant may be added as an additive to the liquid dispersion of the resin particles obtained by the emulsifying (liquid dispersion of polyester resin). Examples of the high acid value-dispersant include copolymer resins having a carboxyl group and salts thereof. Since the surface of the emulsified particles is kept at a state where electrostatic repulsion sufficiently exert due to the addition of the high acid value-dispersant to be adsorbed by the surface of the emulsified particle of the polyester resin, rapid growing of particles in the aggregating may be suppressed. Further, since the electrostatic repulsion effect due to the anionic dissociation groups may also exert in the coalescing described below, adhering of the aggregate particles to each other may be suppressed so that granulation may be stably regulated. A method of adding the high acid value-dispersant after the completion of aggregation and granulation may also suppress adhering of the aggregate particles to each other to stably regulate granulation.

The aggregated particles are formed by adjusting the pH of the liquid dispersion of the starting material to an acidic range, then adding a coagulant at a room temperature (herein defined as from 20° C. to 25° C.) under stirring by a rotary shear homogenizer and dispersing the coagulant into the liquid dispersion of the starting material whose viscosity is increased by the initial aggregation. The pH is preferably in the range of from 2 to 6, and more preferably in the range of from 3 to 6.

The acidic pH range is suitable for the formation of the aggregated particles. However, the pH of the liquid dispersion of resin particles of the polyester resin obtained by the phase inversion emulsification method is within a range of 7 to 8 or the like. Therefore when the liquid dispersion of the colorant or the liquid dispersion of the release agent at a pH of 3 to 5 are mixed therewith, or when the acidic pH is changed to the range of 7 to 8 or the like for performing the aggregating, the balance of polarity may be lost to result in loose aggregations. Then, in a case where the pH of the liquid dispersion of the resin particles of the polyester resin is at the alkaline range, the pH value may be regulated by previously adding a surfactant and a high acid value dispersant at a room temperature to make the surfactant and the dispersant be compatible to the surface of the resin particle, and then mixing the colorant and the release agent.

Examples of the aggregating agent used in the aggregating include a di- or more-valent metal complex as well as an inorganic metal salt and a surfactant which has a polarity reverse to that of the surfactant used as a dispersant for the dispersions. In particular, when the metal complex is used, an amount of the surfactant to be used may be decreased, and charging property may be improved.

Examples of the inorganic metal salt include metal salts such as calcium chloride, calcium nitrate, barium chloride, magnesium chloride, zinc chloride, aluminum chloride or aluminum sulfate, and inorganic metal salt polymers such as polyaluminum chloride, polyaluminum hydroxide, or calcium polysulfide. Among these, in particular, an aluminum salt and a polymer thereof are preferable. The inorganic metal salt preferably has higher valency in view of obtaining a narrower particle size distribution. Namely, divalent rather than monovalent, trivalent rather than divalent, and tetravalent rather than trivalent are more suitable as a valent number of the inorganic metal salt. The metal salt polymer, which has polymerized form can be more suitable among those having the same valecy.

Further, in the aggregating, for suppressing rapid aggregation due to heating, pH may be controlled in a stage of mixing under stirring at a room temperature, and a dispersion stabilizer may be added if necessary.

In view of further improving the chargeability and the powder fluidity in the finally obtained toner, coating may be further performed after the aggregating. In the coating, deposition particles are formed on the surface of the aggregated particles by depositing resin particles, which are formed of a resin which is the same as or different from the binder resin, thereby forming a coating layer (that is, forming a toner of a core-shell structure). The layer is formed by additionally incorporating a liquid dispersion containing the binder resin or other resin particles into the liquid dispersion in which the aggregated particles are formed in the aggregating. Other ingredients may also be added simultaneously. The binder resin (resin particle) used for forming the coating layer are similar to those for forming the core layer. Further, also in the coating, pH and a surfactant are selected in the similar manner to those of the aggregating depending on the resin used, and coated aggregated particles are obtained with considering that the resin is not deposited in a scattered state on the surface of the aggregated particles. The coating may also work for aggregating the starting particles which have not been taken into the aggregated particles in the aggregating.

Coalescing

In the coalescing, the progress of aggregation is stopped by regulating the pH of the liquid suspension of the aggregated particles (or deposited particles) in the range of from 6.0 to 7.5 under a stirring condition pursuant to that in the aggregating, and then heating at a temperature of the same as or higher than the melting temperature of the binder resin is performed to coalesce aggregated particles (or deposited particles). In this regard, if the pH for stopping the aggregation is not appropriate, the aggregated particles may be sometimes disintegrated to worsen the yield or, on the contrary, aggregation may not be stopped in the course of temperature elevation for coalescing and growing of the particle size may further proceed to increase the particle diameter, although this depends on the liquid property of the liquid dispersion containing the aggregated particles and/or the liquid dispersion of starting material.

The heating temperature during the coalescing may be arbitrarily set as long as it is the same as or higher than the melting temperature of a crystalline polyester resin in a case where the crystalline polyester resin is contained in the aggregated particles, or it is the same as or higher than the glass transition temperature of a non-crystalline resin in a case where the crystalline polyester resin is not contained. Heating may be applied for such a time that desired coalescing is attained and it may be from about 0.5 hours to about 3 hours. When heating is applied for a longer time than this, the release agent contained in the aggregated particles may tend to be exposed to the toner surface. Heating may give an undesired effect on the storage stability of the toner, though this may facilitate to improve the flexibility.

The coalescing may further include a cross-linking reaction performed at the time that the binder resin is heated at a higher temperature than its melting temperature or its glass-transition temperature or the time after coalescing is completed. Alternatively, a cross-linking reaction can be simultaneously performed with the coalescing. The cross-linking reaction can be performed by, for example, employing, as a binder resin, an unsaturated crystalline polyester resin formed by copolymerizing a double bond component, and introducing a cross-linking structure thereinto by a radical reaction. Thereupon, the following polymerization initiators can be used.

Examples of the polymerization initiator include t-butylperoxy-2-ethyl hexanoate, cumyl perpivalate, t-butyl peroxylaurate, benzoyl peroxide, lauroyl peroxide, octanoyl peroxide, di-t-butyl peroxide, t-butylcumyl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy)-3,3,5-trimethylcyclohexane, 1,1-bis(t-butylperoxy)cyclohexane, 1,4-bis(t-butylperoxycarbonyl) cyclohexane, 2,2-bis(t-butylperoxy)octane, n-butyl 4,4-bis(t-butylperoxy)valerate, 2,2-bis(t-butylperoxy)butane, 1,3-bis (t-butylperoxyisopropyl)benzene, 2,5-dimethyl-2,5-di(t-butylperoxy)hexane, 2,5-dimethyl-2,5-di(t-butylperoxy) hexane, 2,5-dimethyl-2,5-di(benzoylperoxy)hexane, di-t-butyl diperoxyisophthalate, 2,2-bis(4,4-di-t-butylperoxycyclohexyl)propane, di-t-butylperoxy α-methylsuccinate, di-t-butylperoxydimethyl glutarate, di-t-butyl peroxyhexahydroterephthalate, di-t-butyl peroxyazelate, 2,5-dimethyl-2,5-di(t-butylperoxy)hexane, diethylene glycol-bis(t-butylperoxycarbonate), di-t-butyl peroxytrimethyladipate, tris(t-butylperoxy)triazine, vinyl tris(t-butylperoxy)silane, 2,2'-azobis(2-methylpropionamidine dihydrochloride), 2,2'-azobis[N-(2-carboxyethyl)-2-methylpropionamidine], and 4,4'-azobis(4-cyanowaleric acid). These polymerization initiators may be used singly, or two or more kinds may be used in combination. An amount and a kind of the polymerization initiator can be selected depending on an amount of an unsaturated part in a binder resin, and a kind and an amount of a coexisting colorant.

The polymerization initiator may be incorporated in the binder resin by being mixed thereinto before the emulsifying, or may be incorporated into the aggregation particles in the aggregating. Alternatively, the polymerization initiator incorporated in the binder resin at the coalescing or after the coalescing. When the polymerization initiator is introduced at the aggregating, the coating or the coalescing or after the coalescing, a solution in which the polymerization initiator is dissolved or emulsified can be added to any of the dispersions (resin fine particle dispersion) or the like. For the purpose of regulating a polymerization degree, any known cross-linking agent, chain transfer agent, and polymerization inhibitor may be added to the polymerization initiator.

A particle obtained via the coalescing is subjected to solid-liquid separation by such as filtration, and may be further subjected to washing and/or drying to form a toner particle. In embodiments, in order to assure sufficient charging property and reliability as a toner, the particle is sufficiently washed in the washing.

The drying can be performed by a method such as a conventional vibration-type flowing drying method, a spray drying method, a freeze drying method, and a flash jet method.

The water content of the toner particle after drying (after being left in a circumstance at 28° C./85% RH for three days) is preferably 1.5 mass % or less, and more preferably 1.0 mass % or less. When the water content is within the range, a charged amount of the toner under a high humidity condition may not be lowered and the chargeability of the toner due to the change of humidity may be stabilized.

The water content of the toner is measured by leaving 2 g of a toner in a circumstance at 28° C. and at a humidity of 85% RH for 24 hours and then measuring the evaporation amount of the water content at a heating temperature of 150° C. by using a HALOGEN MOISTURE ANALYZER (trade name, manufactured by Mettler Toledo International Inc.).

Various known external additives such as the inorganic particles or the organic particles may also be added as other ingredients to the toner particles granulated via the drying depending on the purpose.

Contact Angle of Toner to Aqueous De-Inking Solution

In the exemplary embodiment, the contact angle $\theta_1$ (degree) of the toner for forming a contact toner image to the aqueous de-inking solution is smaller than the contact angle $\theta_2$ (degree) of the toner for forming the non-contact toner image to the aqueous de-inking solution.

The contact angle of the toner to the aqueous de-inking solution is measured as described below.

Specifically, the toner diluted with methyl ethyl ketone is coated on an aluminum plate having a surface cleaned with acetone, and dried at a room temperature to form a thin film of a toner. Then, water droplets of an aqueous de-inking solution are added in a dropwise manner to the thus prepared thin film by using DAT (Dynamic Absorption Tester, trade name: FABRO 1100 DAT, manufactured by Fibro Co.) and the contact angle of the aqueous de-inking solution is measured after lapse of one sec from the dropping.

In the actual measurement herein, a value obtained by averaging values for different 8 points is used as the measured value, and an aqueous 0.1 wt % solution of LIPTOL S 2800 (manufactured by LION Corporation) is used as the aqueous de-inking solution. Further, the measurement is performed in a circumstance at a temperature of 23° C. and at a humidity of 55% in all cases.

The angle of the contact of the toner image to the aqueous de-inking solution is measured in the same manner as measurement for the contact angle of the toner to the aqueous de-inking solution except for using a toner image of a printed item instead of the toner thin film.

The contact angle of the toner to the aqueous de-inking solution is specifically explained for a case of using a 0.1 wt % aqueous solution of LIPTOL S 2800 (described above) as the aqueous de-inking solution for the purpose of illustration without limiting the invention.

The contact angle $\theta_1$ (degree) of the toner for forming a contact toner image to the aqueous de-inking solution may be preferably 85 degree or more and 90 degree or less, and more preferably 87 degree or more and 90 degree or less. In a case where $\theta_1$ is within a range described above, improvement for the de-inking property of the contact toner image and suppression for the lowering of the image quality may be achieved. That is, since the penetration of the aqueous de-inking solution to the contact toner image in a case where the $\theta_1$ is within the range is higher than that in the case where $\theta_1$ is larger than the range, the de-inking property may be better. Further, since the hydrophilicity of the toner for forming a contact toner image in a case where the $\theta_1$ is within the range is lower than that in the case where $\theta_1$ is smaller than the range, deterioration of the image quality due to lowering of the toner charge during formation of the contact toner image may be suppressed.

The contact angle $\theta_2$ (degree) of the toner for forming the non-contact toner image to the aqueous de-inking solution is preferably 92.5 degree or more and 95 degree or less, and more preferably 93.5 degree or more and 95 degree or less. In a case where $\theta_2$ is within the range, both the de-inking property and the image quality of the non-contact toner image may be good.

$\theta_1$ and $\theta_2$ satisfy the relation of $\theta_1<\theta_2$. Since $\theta_1$ and $\theta_2$ satisfy the relation, both the de-inking property and the image quality may become satisfactory. That is, the de-inking property of the entire formed image may be improved by increasing the penetration of the aqueous de-inking solution to the contact toner image which tends to form a hairy toner, and the quality of the formed image may become satisfactory by suppressing lowering of charge via suppressing the hygroscopicity of the toner for forming the non-contact toner image.

The difference between $\theta_1$ and $\theta_2$, that is, the value for $\theta_2-\theta_1$ is, preferably in the range of from about 2.5 degree to about 10 degree, more preferably in the range of from about 3.5 degree to about 8 degree, and further preferably in the range of from about 4 degree to 7 degree. When the value for $\theta_2-\theta_1$ is within the range, the de-inking property and the image quality of the formed image may be more satisfactory.

With respect to the angle of the contact of the toner to other aqueous de-inking solution (an aqueous de-inking solution of a higher alcohol compound other than the aqueous 0.1 wt % solution of LIPTOL S 2800 (described above)), although the absolute value thereof may sometimes vary from the values of $\theta_1$ or $\theta_2$ explained above, the value may not be greatly different unless the temperature and the humidity of the measuring circumstance do not change. That is, the preferred range for the contact angle of the toner to other de-inking solution may not be greatly deviate from the range explained above.

Particularly, the magnitude correlation between $\theta_1$ and $\theta_2$ does not change even in a case of using other aqueous de-inking solution. Accordingly, so long as the condition for the contact angle to the aqueous 0.1 wt % solution of the LIPTOL S 2800 (described above) is satisfied, the de-inking property may be good and lowering of the image quality may be suppressed also in a case of using other aqueous de-inking solutions containing other higher alcohol compound(s) in the actual de-inking.

Examples of the method of regulating the contact angle of the toner to the aqueous de-inking solution include: a method of adjusting the kind and the content ratio of monomer constituent units of the binder resin contained in the toner; a method of adjusting the content of the crystalline resin in the binder resin; and a method of adjusting the content of the release agent in the toner.

Specifically, examples of the method of decreasing the contact angle include a method of increasing the acid value of the binder resin. Particularly in a case of using a polyester resin as the binder resin, the method may include increasing the amount of the polyvalent carboxylic acid component.

Examples of the method of increasing the contact angle include: a method of using a monomer having a long alkyl chain as the monomer for forming the binder resin; a method of increasing the content of the crystalline resin in the binder resin; and a method of increasing the content of the release agent in the toner.

The contact angle of the toner image formed on the recording medium in the printed item to the aqueous de-inking solution ($\theta_1$ and $\theta_2$) is similar to the contact angle of the toner used for forming the toner image to the aqueous de-inking solution. Accordingly, description therefor is herein omitted.

Other Properties of Toner

In embodiments, the L* value in the CIE 1976 (L*a*b*) color system of the toner for forming a contact toner image may be larger than the L* value of the toner for forming the non-contact toner image.

In embodiments, the toner for forming a contact toner image may contain substantially no colorant, and in embodiments, the toner for forming a contact toner image is substantially colorless and transparent, with a view point of suppressing coloration by the residual toner after the de-inking treatment.

Specifically, the L* value of the toner for forming a contact toner image is, preferably, 85 or more and less than 94 and, more preferably, 90 or more and less than 94 with a view point of suppressing coloration by the residual toner after the de-inking treatment.

The L* value of the toner may be controlled by the kind and the content of the colorant contained in the toner and the dispersion state thereof.

Further, the L* value of the toner may be determined by measurement using a spectrophotometer (trade name: X-RITE 939, manufactured by X-Rite Co.)

In embodiments, the volume average particle size of the toner is preferably in the range of from about 1 μm to about 20 μm, and more preferably in the range of from about 2 μm to about 8 μm. In embodiments, the number average particle size of the toner is preferably in the range of from about 1 μm to 20 μm, and more preferably in the range of from about 2 μm to about 8 μm.

The volume average particle size and the number average particle size may be measured by using COULTER MULTISIZER MODEl II (trade name, manufactured by Beckman Coulter Co.) with an aperture diameter of 50 μm. In this case, measurement may be performed after dispersing the toner in an aqueous electrolyte (aqueous Isoton solution) and supersonically dispersing the same for 30 seconds or more.

For the measured particle size distribution, a cumulative distribution is drawn from the side of smaller diameter on the volume or the number of the particle with respect to the divided particle size range (channel). The particle size corresponding to 50% accumulation of the volume is defined as a volume average particle size, and the particle size corresponding to 50% accumulation of the number is defined as a number average particle size.

Developer

Examples of a system of the developer used in the exemplary embodiment include a one-component developer, in which the toner is used as it is, and a two-component developer, in which the toner is mixed with a carrier.

The carrier used in the two-component developer is not particularly limited, and any known carrier can be used. Examples thereof include magnetic metals such as iron oxide, nickel, or cobalt; magnetic oxides such as ferrite or magnetite; resin-coated carriers each having a resin coating layer on the surface of a core formed of the metals or magnetic oxides; and magnetic dispersion type carriers. The carrier may also be a resin dispersion carrier, in which an electrically conductive material is dispersed in a matrix resin.

Examples of a coating resin or a matrix resin used in the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin having organosiloxane bonds and a modified product thereof; fluororesin, polyester, polycarbonate, phenolic resin, and epoxy resin.

Examples of the electrically conductive material include, but are not limited to, metals such as gold, silver or copper; carbon black, titanium oxide, zinc oxide, barium sulfate, aluminum borate, potassium titanate, and tin oxide.

Examples of the core material of the carrier include magnetic metals such as iron, nickel or cobalt; magnetic oxides such as ferrite or magnetite, and a glass bead. In embodiments, the core material is a magnetic substance when the carrier is used in a magnetic brush method. The volume-average particle diameter of the core of the carrier is generally in the range of from about 10 μm to about 500 μm, and preferably in the range of from about 30 μm to about 100 μm.

Examples of a method to coat the surface of the core of the carrier with resin include a method in which a coating liquid for forming a resin layer in which a coating resin and other optional additives is/are dissolved in an appropriate solvent is applied to the surface of the core to form a coating layer. The solvent is not particularly limited, and may be selected as appropriate in consideration of the type of the coating resin used, suitability for coating, and the like.

Specific examples of the resin coating method include: a dipping method in which the core of a carrier is dipped in a coating liquid; a spray method in which a coating liquid is sprayed onto the surface of the core of a carrier; a fluidized bed method in which a coating liquid is sprayed onto the core of the carrier that is being floated by fluidizing air; and a kneader coater method in which the core of a carrier is mixed with a coating liquid in a kneader coater and the solvent is removed.

In embodiments, the mixing ratio (ratio by mass) of the toner to the carrier in the two-component developer is preferably in the range of from about 1:100 (toner to carrier) to about 30:100, and more preferably in the range of from about 3:100 to about 20:100.

Recording Medium

Examples of the recording medium used in the exemplary embodiments include recording paper used customarily such as plain paper or usual printing paper. Specifically, those containing pulp fibers (and optionally fillers) as a main component may be used. Examples of the recording medium used in the exemplary embodiments further include those in which pulp fibers are exposed to the surface thereof for forming the toner image.

Examples of the pulp fibers include chemical pulps. Specific examples thereof include hard wood bleached craft pulps, hard wood unbleached craft pulps, soft wood bleached craft pulps, soft wood unbleached craft pulps, hard wood bleached sulfite pulps, hard wood unbleached sulfite pulps, soft wood bleached sulfite pulps, and soft wood unbleached sulfite pulps, as well as pulps prepared by chemically treating fiber materials such as wood, cotton, linen, or bast.

Further, ground wood pulps formed by mechanically pulping woods or chips, chemimechanical pulps formed by impregnating woods or chips with chemicals and then mechanically pulping them, thermomechanical pulps formed by pulping chips by a refiner after digesting the chips to a somewhat softened state, and chemithermomechanical pulps having a feature of high yield are also used. They may be used only from virgin pulps or, those with additional waste paper pulps if necessary.

The virgin pulps may be those subjected to a bleaching treatment by a bleaching method of using chlorine dioxide without using a chlorine gas (Elementally Chlorine Free: ECF) or those subjected to a bleaching method mainly using ozone/hydrogen peroxide without using a chlorine compound at all (Total Chlorine Free: TCT). Examples of the raw materials for the waste paper pulps, which may be blended in accordance with purposes, include not-printed waste paper such as offcuts, defective wastes, or cut pieces of paper of upper white region, extra upper region, and inside white region formed due to reducing width of the paper, which are non-printed white paper released from book binderies, printing works, cutting factories, or the like; printed wood free waste paper such as printed or copied, wood free coat paper, wood free paper; waste paper manuscripted with aqueous ink, oil ink, or pencil; waste newspaper including leaflets such as printed wood free paper, wood free coat paper, wood-containing paper or wood-containing coat paper; and waste paper such as wood-containing paper, wood-containing coat paper, or woody paper.

The waste paper pulp may be those obtained by treating the raw materials by at least one of the ozone bleaching treatment and the hydrogen peroxide bleaching treatment. The ozone bleaching treatment has an effect of decomposing fluorescence dyes and the like which are usually contained in the wood-free paper. The hydrogen peroxide bleaching treatment has an effect of suppressing yellowing due to alkalis which are used during the de-inking treatment.

With a viewpoint of further improving the whiteness, the blending ratio of the waste paper pulp obtained by the bleaching treatment may be in the range of from 50 mass % to 100 mass % with respect to the total amount of the pulp used in the recording paper. Further, with a viewpoint of recycling the resource, the blending ratio of the waste paper pulp may be in the range of from 70 mass % to 100 mass % with respect to the total amount of the pulp used in the recording paper.

By employing the ozone bleaching treatment and the hydrogen peroxide bleaching treatment in combination to treat the waste paper pulp, the waste paper may be deinked easily as well as the whiteness of the pulp may be further improved.

Further, since these treatments also have an effect of decomposing and removing the residual chlorine compounds in the pulp, decreasing of the amount of organic halogen compounds in the waste paper pulp subjected to chlorine bleaching may be achieved.

In addition to the pulp fibers, a filler may also be added to the recording paper if it is necessary for controlling the opacity, whiteness, and the surface property. When the halogen content in the recording paper is desired to be decreased, a filler which substantially does not contain halogen may be used.

Examples of the filler include an inorganic pigment such as heavy calcium carbonate, light calcium carbonate, chalk, kaolinite, calcined clay, talc, calcium sulfate, barium sulfate, titanium dioxide, zinc oxide, zinc sulfide, zinc carbonate, aluminum silicate, calcium cilicate, magnesium silicate, synthesized silica, aluminum hydroxide, alumina, sericite, white carbon, saponite, calcium montmorillonite, sodium montmorillonite, or bentonite, as well as an organic pigment such as acrylic plastic pigment, polyethylene, chitosan particles, cellulose particles, polyamino acid particles, or urea resin.

In a case of blending the waste paper pulp to the recording paper, the ash content contained in the raw waste paper pulp material to may be previously estimated to adjust the addition amount of the waste paper pulp.

While the blending amount of the filler is not particularly restricted, it may be preferably in the range of from 1 part by mass to 80 parts by mass, and more preferably in the range of from 1 part by mass to 50 parts by mass, based on 100 parts by mass of the pulp fibers.

EXAMPLES

Hereinafter, the exemplary embodiment is explained with referring to the Examples, although the invention is not limited thereto. In the followings, "part(s)" and "%" refer to "part(s) by weight" and "% by weight" unless specifically mentioned.

Measuring Method

Measuring Method for Contact Angle of Toner or Toner Image to Aqueous De-Inking Solution A toner diluted with methyl ethyl ketone is coated on an aluminum sheet having a surface cleaned with acetone, and is dried at a room temperature to prepare a thin film of the toner. Then, droplets of an aqueous de-inking solution (0.1 wt %-aqueous solution of LIPTOL S 2800 (described above)) are added by using DAT (Dynamic Absorption Tester, fabro 1100 DAT) manufactured by Fibro Co., and the contact angle of the aqueous de-inking solution after lapse of one sec from the dropping is measured.

The measurement is performed for different 8 points. The values of the 8 points are averaged, and the thus-obtained average value is defined as the "contact angle of toner to aqueous de-inking solution".

The contact angle of the toner image to the aqueous de-inking solution is measured in the same manner as the measurement for the contact angle of the toner to the aqueous de-inking solution, except that the toner image on a printed item is used instead of the thin film of the toner.

Measuring Method for Glass Transition Temperature and Melting Temperature

The glass transition temperature and the melting temperature are measured according to JIS K 7121-1987, which corresponds to ISO 3146 1985 and the disclosure of which is incorporated by reference herein, by using a differential scanning calorimeter (DSC 3110, Thermoanalysis System 001: trade name, manufactured by MAC Science Co.). The melting temperature of a mixture of indium and zinc is used in the compensation of temperature for the detection portion of the equipment, and melting heat of indium is used in the compensation of heat calorie. A specimen is placed in an aluminum pan. The aluminum pan in which the sample is present and an empty aluminum pan for comparison are set and measurement is performed at a temperature elevation rate of 10° C./min.

In the endothermic peak of a DSC curve obtained by the measurement, the temperature at the top of the highest endothermic peak is defined as the melting temperature.

Further, a temperature at the intersection between a base line and an extension of a leading edge in the endothermic portion of the DSC curve obtained by the measurement is defined as the glass transition temperature.

Measurement for Weight Average Molecular Weight (Mw)

The weight average molecular weight (Mw) of a polyester resin (in terms of polystyrene) is measured by using GPC (HLC-8120: trade name, manufactured by TOSOH Corp.). GPC spectra are measured in a THF solvent by using the TSK gel Super HM-M (15 cm) (described above) as the column. The molecular weight of the polyester resin is calculated by using a molecular weight calibration curve prepared from a standard specimen of mono dispersed polystyrene.

Measuring Method for Volume Average Particle Size of Toner

A volume average particle size of the toner is measured by using COULTER MULTISIZER MODEL II (trade name, manufactured by Beckman Coulter Co.) as a measuring equipment and ISOTON-II (trade name, manufactured by Beckman Coulter Co.) as an electrolyte.

0.5 mg of a specimen to be measured is added into 2 ml of an aqueous solution containing 5% of a surfactant (sodium dodecyl benzene sulfonate) as a dispersant. The resultant solution is added to 100 ml of the electrolyte. The electrolyte in which the specimen to be measured is suspended is subjected to a dispersion treatment for one minute in a supersonic dispersing device, and the particle size distribution of particles with the particle diameter in the range of from 2.0 μm to 60 μm is measured by the COULTER MULTISIZER MODEL II (described above) by using an aperture of 100 μm aperture diameter. The number of measured particles is 50,000.

For the measured particle size distribution, a cumulative distribution is drawn from the side of a smaller diameter on the volume with respect to the divided particle size range (channel), and the particle size corresponding to 50% accumulation is defined as a volume average particle size.

Measuring Method for Average Particle Sizes of Resin Particle, Release Agent Particle and Pigment Particle Volume average particle sizes of resin particles, release agent particles, and pigment particles are measured by using a laser diffraction particle size distribution measuring equipment (LA-700: trade name, manufactured by HORIBA Ltd.).

A specimen in a state of a liquid dispersion is adjusted such that the solid content is 2 g. An ion exchanged water is added to the solution to make up the solution to 40 ml. The solution is charged into a cell to be an appropriate concentration and, when the concentration in the cell is stabilized after 2 min, the volume average particle size is measured.

The volume average particle size on every obtained channel is accumulated from the side of a smaller volume average particle size, and the particle size corresponding to 50% accumulation is defined as the volume average particle size.

In a case of measuring a powder material, 2 g of a specimen to be measured is added to 50 ml of an aqueous 5% solution of a surfactant (sodium dodecyl benzene sulfonate), and subjected to dispersing by a supersonic dispersing machine (1,000 Hz) for 2 min to prepare a specimen, and the particle size is measured by the same method as that for the liquid dispersion.

Manufacture of Toner

Preparation of Cyan Toner C1 (Toner for Forming Non-Contact Toner Image, Contact Angle: 94 Degree)

Formulation of Liquid Dispersion of Non-Crystalline Polyester Resin Particle (1):

| | |
|---|---|
| 2 mol-propylene oxide adduct of bisphenol A | 310 parts |
| Terephthalic acid | 116 parts |
| Fumaric acid | 12 parts |
| Dodecenyl succinic acid | 54 parts |
| $Ti(OBu)_4$ | 0.05 parts |

The starting materials shown above are put in a three necked flask dried under heating, and air in the 3-necked flask is replaced with nitrogen by a pressure-reducing operation to form an inert atmosphere. The content of the flask is refluxed with mechanical stirring at 180° C. for 5 hours. Then, the temperature is gradually elevated to 240° C. while distilling off water formed in the reaction system by vacuum distillation. Further, dehydrating condensation is continued at 240° C. for 2 hours, and the molecular weight is confirmed by GPC when the content becomes a viscous state, and the vacuum distillation is stopped when the weight average molecular weight of a non-crystalline polyester resin (1) to be obtained reaches 22000. The non-crystalline polyester resin (1) is non-crystalline, and has a glass transition temperature of 60° C. and an acid value of 14 mgKOH/g.

100 parts of the non-crystalline polyester resin (1), 50 parts of ethyl acetate, 25 parts of isopropyl alcohol, and 5 parts of an aqueous 10 mass % ammonia solution are placed in a separable flask, and after mixing and dissolving them sufficiently, ion exchanged water is added in a dropwise manner at a liquid flow rate of 8 g/min by using a liquid delivery pump while stirring under heating at 40° C. After the liquid becomes turbid, the liquid delivery rate is increased to 25 g/min to invert the phase, and dropping is stopped when the liquid delivery amounts to 135 parts. Then, the solvent is removed under a reduced pressure to obtain a liquid dispersion of the non-crystalline polyester resin (1). The volume average particle size of the obtained polyester resin particle is 132 nm, and the solid concentration of the polyester resin particles is 38%.

Liquid Dispersion of Crystalline Polyester Resin (1)

230 parts of 1,10-dodecanic diacid, 160 parts of 1,9-nonanediol, and 0.2 parts of dibutyl tin oxide as a catalyst are placed in a 3-necked flask dried under heating, and then air in the 3-necked flask is replaced with nitrogen by a pressure-reducing operation to form an inert atmosphere. The content of the flask is stirred and refluxed by a mechanical stirring at 180° C. for 5 hours and refluxed to proceed reaction. During the reaction, water formed in the reaction system is distilled off. Then, temperature is gradually elevated to 230° C. under a reduced pressure, and the molecular weight is confirmed by GPC when the content becomes a viscous state after stirring for 2 hours. The vacuum distillation is stopped when the weight average molecular weight of a crystalline polyester resin to be obtained reaches 29000. The crystalline polyester resin has a melting temperature of 73° C. and an acid value of 12 mgKOH/g.

100 parts of the crystalline polyester resin, 35 parts of ethyl acetate, and 35 parts of isopropyl alcohol are placed in a separable flask, and after mixing and dissolving them sufficiently at 75° C., 5.5 parts of aqueous 10% ammonia solution are added in a dropwise manner. The heating temperature is lowered to 60° C., and ion exchanged water is added in a dropwise manner at a liquid delivery rate of 6 g/min by using a liquid delivery pump. After the liquid becomes turbid, the liquid delivery rate is increased to 25 g/min and dropping of the ion exchanged water is stopped when the total amount of the liquid reaches 400 parts. Then, the solvent is removed under a reduced pressure to obtain a liquid dispersion of a crystalline polyester resin. The volume average particle size of the obtained crystalline polyester resin particles is 136 nm, and the solid concentration of the polyester resin particle is 11.5%.

Liquid Dispersion of Colorant

| | |
|---|---|
| Cyan pigment (C.I. Pigment Blue 15:3 (copper phthalocyanine)), manufactured by Dainichiseika Color & Chemicals Mfg. Co., Ltd.) | 100 parts |

-continued

| | |
|---|---|
| Anionic surfactant (Neogen R: trade name, manufactured by DAI-ICHI KOGYO SEIYAKU CO., LTD.) | 15 parts |
| Ion exchanged water | 900 parts |

The ingredients shown above are mixed and dissolved, and further subjected to dispersing for one hour by using a high pressure impact dispersing machine Altimizer (trade name: HJP 3006, manufactured by Sugino Machine Ltd.) to prepare a liquid dispersion of a colorant in which a colorant (cyan pigment) is dispersed. In the liquid dispersion of the colorant, the average particle size of the colorant (cyan pigment) is 0.13 μm, and the concentration of the colorant particle is 25%.

Liquid Dispersion of Release Agent

| | |
|---|---|
| Ester wax (WEP 5: trade name, manufactured by NOF Corp. | 50 parts |
| Anionic surfactant (NEOGEN RK: trade name, manufactured by Dai-Ichi Kogyo Seiyaku Co., Ltd.) | 5 parts |
| Ion exchanged water | 200 parts |

The above ingredients are subjected to heating at 110° C. and dispersing by using a homogenizer (trade name: ULTRA TURRAX T50, manufactured by IKA Co.), and further subjected to dispersing with a MONTON-GAULIN HOMOGENIZER (trade name, manufactured by Gaulin Inc.) to prepare a liquid dispersion of a release agent in which a release agent with an average particle size of 0.24 μm is dispersed (concentration of release agent: 23%).

Preparation of Toner

| | |
|---|---|
| Liquid dispersion of non-crystalline polyester resin particle (1) | 302.6 parts |
| Liquid dispersion of crystalline polyester resin (1) | 30.0 parts |
| Liquid dispersion of colorant | 48.0 parts |
| Anionic surfactant (trade name: DOWFAX 2A1, manufactured by Dow Chemcal Company; 20%-aqueous solution) | 11.5 parts |
| Liquid dispersion of release agent | 80.2 parts |

The liquid dispersion of the non-crystalline polyester resin particle (1), the liquid dispersion of the crystalline polyester resin (1), and the anionic surfactant among the starting materials, and 631 parts of ion exchanged water are placed in a polymerization vessel equipped with a pH meter, a stirring blade, and a thermometer. While stirring them at 200 rpm for 15 min, the surfactant is made to be compatible to the liquid dispersion of the non-crystalline polyester resin particles (1). After adding and mixing the liquid dispersion of the colorant and the liquid dispersion of the release agent thereto, an aqueous 0.3 M solution of nitric acid is added to the starting mixture to adjust pH to 2.7. Then, 100 parts of an aqueous 10% solution of aluminum sulfate is added to the resultant in a dropwise manner as a coagulant while applying shear force at 1000 rpm by ULTRA TURRAX T50 (described above). Since the viscosity of the starting mixture increases in the course of the dropping of the coagulant, the dropping speed is moderated at the instance the viscosity is increased so that the coagulant is not localized. After the completion of the dropping of the coagulant, stirring is performed for 5 min while further increasing the number of rotation to 6000 rpm to sufficiently mix the coagulant and the starting mixture.

Then, the starting mixture is stirred at 550 rpm to 650 rpm under heating at 30° C. by a mantle heater. After stirring for 60 min, stable formation of primary particle diameter is confirmed by using the COULTER MULTISIZER MODEL II (described above) (an aperture diameter: 50 μm) and then the temperature is elevated to 45° C. at 0.5° C./min for growing the aggregated particles. Growing of the aggregated particles is appropriately confirmed by using the COULTER MULTISIZER MODEL II (described above), and the aggregation temperature or the number of rotation for stirring are changed depending on the aggregation rate.

On the other hand, for coating aggregated particles, 75.5 parts of ion exchanged water and 5.6 parts of an anionic surfactant (trade name: DOWFAX 2A1, manufactured by Dow Chemical Company: aqueous 20% solution) are added to 147.4 parts of a liquid dispersion of the non-crystalline polyester resin particles (1) and mixed to prepare a liquid dispersion of resin particles for coating which is previously adjusted to pH 2.7. When the aggregated particles grow to have a diameter of 5.0 μm in the aggregating, the liquid dispersion of the resin particles (1) for coating is added and kept for 10 min under stirring. Then, for stopping the growing of the aggregated particles (deposited particles), 16.7 parts of an aqueous EDTA solution (trade name: CHELEST 40, manufactured by CHELEST Corp.) diluted to 12% concentration with ion exchanged water and an aqueous 1M solution of sodium hydroxide are successively added to control the pH of the starting mixture to 6.5. Then, for coalescing the aggregated particles, temperature is elevated to 85° C. at a temperature elevation rate of 1° C./min while adjusting pH to 6.5. After confirming the coalescing of aggregated particles by an optical microscope, iced water is injected, and the resultant is cooled rapidly at a temperature lowering rate of 100° C./min.

The slurry of the obtained particles after cooling is adjusted to pH 9.0 with an aqueous solution of 1N sodium hydroxide, and stirred for 20 min, and then the particles are once sieved through a 20 μm mesh screen. Then, warm water (50° C.) is added in an amount of about ten times the solid content. The resultant is stirred for 20 min while adjusting the pH to 9.0, subjected to warm alkali cleaning, and filtered once. Then, the solids remaining on filter paper are dispersed in the slurry, and cleaned repeatedly for three times with warm water at 40° C. Further, acid washing is performed at 40° C. while adjusting the pH of the slurry to 4.0 by adding an aqueous solution of 0.3N nitric acid. Then, the resultant is finally cleaned under stirring with ion exchanged water at 40° C. and dried to obtain core toner particles (A1) with a volume average particle size of 6.4 μm.

To the thus-obtained core toner particles (A1), a silica powder (particle diameter: 50 nm) and a titania powder (particle diameter: 40 nm) are added in amounts of 0.9 parts and 0.6 parts respectively as external additives each based on 100 parts of the core toner particles (A1), and mixed in a Henschel mixer to provide a cyan toner C1.

Table 1 shows the contact angle to the aqueous de-inking solution and the L* value of the cyan toner C1.

Preparation of Cyan toner C2 (toner for forming non-contact toner image, contact angle: 92.5 degree) A cyan toner C2 is obtained in the same manner as the cyan toner C1, except for using 150 parts of 2 mol-ethylene oxide adduct of bisphenol A and 150 parts of 2 mol-propylene oxide adduct of bisphenol A instead of 310 parts of 2 mol-propylene oxide adduct of bisphenol A in the starting materials for the liquid dispersion (1) of the non-crystalline polyester resin particles.

Table 1 shows the contact angle to the aqueous de-inking solution and the L* value of the cyan toner C2.

Preparation of Magenta toner M1 (toner for forming non-contact toner image, contact angle: 93.5 degree)

A magenta toner M1 is obtained in the same manner as the cyan toner C1, except for using 100 parts of a magenta pigment (C.I. pigment Red 122, manufactured by Clariant Co.) instead of the cyan pigment used for the liquid dispersion of the colorant.

Table 1 shows the contact angle to the aqueous de-inking solution and the L* value of the magenta toner M1.

Preparation of Magenta toner M2 (toner for forming non-contact toner image, contact angle: 93 degree)

A magenta toner M2 is obtained in the same manner as the cyan toner C2, except for using 100 parts of a magenta pigment (C.I. pigment Red 122, manufactured by Clariant Co.) instead of the cyan pigment used for the liquid dispersion of the colorant.

Table 1 shows the contact angle to the aqueous de-inking solution and the L* value of the magenta toner M2.

Preparation of Yellow toner Y1 (toner for forming non-contact toner image, contact angle: 95 degree)

A yellow toner Y1 is obtained in the same manner as the cyan toner C1, except for using 120 parts of a yellow pigment (C.I. pigment Yellow 74, manufactured by Clariant Co.) instead of the cyan pigment used for the liquid dispersion of the colorant.

Table 1 shows the contact angle to the aqueous de-inking solution and the L* value of the yellow toner Y1.

Preparation of Yellow toner Y2 (toner for forming non-contact toner image, contact angle: 93 degree)

A yellow toner Y2 is obtained in the same manner as the cyan toner C2, except for using 120 parts of a yellow pigment (C.I. pigment Yellow 74, manufactured by Clariant Co.) instead of the cyan pigment used for the liquid dispersion of the colorant.

Table 1 shows the contact angle to the aqueous de-inking solution and the L* value of the yellow toner Y2.

Preparation of Yellow toner Y3 (toner for forming contact toner image, contact angle: 88 degree)

A yellow toner Y3 is obtained in the same manner as the yellow toner Y1 except for using 300 parts of 2 mol-ethylene oxide adduct of bisphenol A instead of 310 parts of 2 mol-propylene oxide adduct of bisphenol A, changing the addition amount of the dodecenyl succinic acid to 30 parts, changing the addition amount of the fumaric acid to 20 parts in the starting material for the liquid dispersion (1) of the non-crystalline polyester resin particles, and changing the amount of the liquid dispersion (1) of the crystalline polyester resin to 10 parts during preparation of the toner.

Table 1 shows the contact angle to the aqueous de-inking solution and the L* value of the yellow toner Y3.

Preparation of Black toner K1 (toner for forming non-contact toner image, contact angle: 95 degree)

A black toner K1 is obtained in the same manner as the cyan toner C 1, except for using 100 parts of a black pigment (trade name: REGAL 330, manufactured by Clariant Co.) instead of the cyan pigment used for the liquid dispersion of the colorant.

Table 1 shows the contact angle to the aqueous de-inking solution and the L* value of the black toner K1.

Preparation of Black toner K2 (toner for forming non-contact toner image, contact angle: 92.5 degree)

A black toner K2 is obtained in the same manner as the cyan toner C2, except for using 100 parts of a black pigment (trade name: REGAL 330, manufactured by Clariant Co.) instead of the cyan pigment used for the liquid dispersion of the colorant.

Table 1 shows the contact angle to the aqueous de-inking solution and the L* value of the black toner K2.

Preparation of Black toner K3 (toner for forming contact toner image, contact angle: 88 degree)

A black toner K3 is obtained in the same manner as the yellow toner Y3, except for using 100 parts of a black pigment (trade name: REGAL 330, manufactured by Clariant Co.) instead of the yellow pigment used for the liquid dispersion of the colorant.

Table 1 shows the contact angle to the aqueous de-inking solution and the L* value of the black toner K3.

Preparation of Colorless toner S1 (toner for forming contact toner image for comparison, contact angle: 95 degree)

A colorless toner S1 is obtained in the same manner as the cyan toner C 1, except for omitting the use of the cyan pigment used for the liquid dispersion of the colorant.

Table 1 shows the contact angle to the aqueous de-inking solution and the L* value of the colorless toner S1.

Preparation of Colorless toner S2 (toner for forming contact toner image for comparison, contact angle: 88 degree)

A colorless toner S2 is obtained in the same manner as the yellow toner Y3, except for omitting the use of the yellow pigment used for the liquid dispersion of the colorant.

Table 1 shows the contact angle to the aqueous de-inking solution and the L* value of the colorless toner S2.

Preparation of Colorless toner S3 (toner for forming contact toner image, contact angle: 88 degree)

A colorless toner S3 is obtained in the same manner as the colorless toner S1 except for using 300 parts of 2 mol-ethylene oxide adduct of bisphenol A instead of 310 parts of 2 mol-propylene oxide adduct of bisphenol A, changing the addition amount of the dodecenyl succinic acid to 15 parts, changing the addition amount of the fumaric acid to 28 parts in the starting material for the liquid dispersion (1) of the non-crystalline polyester resin particles, and changing the amount of the liquid dispersion (1) of the crystalline polyester resin to 10 parts during preparation of the toner.

Table 1 shows the contact angle to the aqueous de-inking solution and the L* value of the colorless toner S3.

Preparation of Colorless toner S4 (toner for forming contact toner image, contact angle: 88 degree)

A colorless toner S4 is obtained in the same manner as the colorless toner S1 except for using 300 parts of 2 mol-ethylene oxide adduct of bisphenol A instead of 310 parts of 2 mol-propylene oxide adduct of bisphenol A, and changing the amount of the liquid dispersion (1) of the crystalline polyester resin to 10 parts during preparation of the toner.

Table 1 shows the contact angle to the aqueous de-inking solution and the L* value of the colorless toner S4.

TABLE 1

| Toner | Contact angle (degree) | L* value |
|---|---|---|
| Cyan toner C1 | 94 | 65 |
| Cyan toner C2 | 92.5 | 64 |
| Magenta toner M1 | 93.5 | 59 |
| Magenta toner M2 | 93 | 59 |
| Yellow toner Y1 | 95 | 91 |
| Yellow toner Y2 | 93 | 90 |
| Yellow toner Y3 | 88 | 91 |
| Black toner K1 | 95 | 20 |
| Black toner K2 | 92.5 | 19 |
| Black toner K3 | 88 | 20 |
| Colorless toner S1 | 95 | 93 |
| Colorless toner S2 | 88 | 92 |
| Colorless toner S3 | 85 | 92 |
| Colorless toner S4 | 90 | 93 |

Preparation of Developer 15 parts of a resin formed by copolymerization of styrene/methyl methacrylate/isobutyl methacrylate in a mass ratio of 30/60/10 (molecular weight: 82000, manufactured by Soken Chemical & Engineering Co., Ltd.) is dissolved in 500 parts of toluene. 100 parts of ferrite particles (volume average particle size: 35 μm) are added thereto, and distillation is performed under the reduced pressure in a kneader to provide a resin coated carrier.

36 g of the toner and 414 g of the carrier are placed in a 2 liter V blender, stirred for 20 min, and then sieved through a mesh of 212 μm pore size to provide a developer.

Image Formation

Examples α1 to α4 and Comparative Example α1

Image formation is performed by the following method using the image forming apparatus which has the same construction as in the first exemplary embodiment (refer to FIG. 1) and accommodates developers containing toners shown in Table 2 in the toner cartridges 8S, 8Y, 8C, 8M, and 8K.

Specifically, the image formation apparatus is put to seasoning (pre-conditioning operation) in a circumstance at a room temperature of 28° C. and at a humidity of 85% for 48 hours. Then, 2×2 $cm^2$ patches, which have the toner carrying amount of4 [$g/m^2$] per area for each color (4.8 [$g/m^2$] only for the toner of K color), is stacked on the surface of 3×3 $cm^2$ recording paper of 75 $g/m^2$ (trade name: C2, manufactured by Fuji Xerox Interfiled Co.) to form a non-fixed image where all toner images are stacked on the recording paper. Then, the not-fixed image is fixed to the recording paper at a fixing temperature of 170° C. to form a printed item in which all toner images are stacked and fixed on the recording paper.

In the thus-formed printed item, the contact toner image is a toner image formed by the toner accommodated in the toner cartridge 8S.

Each of $\theta_{11}$, $\theta_{21}$, $\theta_{22}$, $\theta_{23}$, and $\theta_{24}$ in Table 2 means the contact angles of the corresponding toner to the aqueous de-inking solution.

TABLE 2

| | 8S | | 8Y | | 8C | | 8M | | 8K | |
|---|---|---|---|---|---|---|---|---|---|---|
| | Toner | $\theta_{11}$ (degree) | Toner | $\theta_{21}$ (degree) | Toner | $\theta_{22}$ (degree) | Toner | $\theta_{23}$ (degree) | Toner | $\theta_{24}$ (degree) |
| Example α1 | S2 | 88 | Y1 | 95 | C1 | 94 | M1 | 93.5 | K1 | 95 |
| Example α2 | S3 | 85 | Y1 | 95 | C1 | 94 | M1 | 93.5 | K1 | 95 |
| Example α3 | S4 | 90 | Y1 | 95 | C1 | 94 | M1 | 93.5 | K1 | 95 |

TABLE 2-continued

| | 8S | | 8Y | | 8C | | 8M | | 8K | |
|---|---|---|---|---|---|---|---|---|---|---|
| | Toner | $\theta_{11}$ (degree) | Toner | $\theta_{21}$ (degree) | Toner | $\theta_{22}$ (degree) | Toner | $\theta_{23}$ (degree) | Toner | $\theta_{24}$ (degree) |
| Example α4 | S3 | 85 | Y2 | 93 | C2 | 92.5 | M2 | 93 | K2 | 92.5 |
| Comp. Example α1 | S1 | 95 | Y3 | 88 | C2 | 92.5 | M2 | 93 | K3 | 88 |

Examples β1 and β2

Image formation is performed by the following method using the image forming apparatus which has the same construction as in the second exemplary embodiment (refer to FIG. 3) and accommodates developers containing toners shown in Table 3 in the toner cartridges 8Y, 8C, 8M, and 8K.

Specifically, the image formation apparatus is put to seasoning (pre-conditioning operation) in a circumstance at a room temperature of 28° C. and at a humidity of 85% for 48 hours. Then, 2×2 $cm^2$ patches, which have the toner carrying amount of 4 [$g/m^2$] per area for each color (4.8 [$g/m^2$] only for the toner of K color), is stacked on the surface of 3×3 $cm^2$ recording paper of 75 $g/m^2$ (trade name: C2, described above) to form a non-fixed image where all toner images are stacked on the recording paper. Then, the not-fixed image is fixed to the recording paper at a fixing temperature of 170° C. to form a printed item in which all toner images are stacked and fixed on the recording paper.

In the thus-formed printed item, the contact toner image is a toner image formed by the toner accommodated in the toner cartridge 8Y.

Each of $\theta_{12}$, $\theta_{22}$, $\theta_{23}$, and $\theta_{24}$ in Table 3 means the contact angles of the corresponding toner to the aqueous de-inking solution.

TABLE 3

| | 8Y | | 8C | | 8M | | 8K | |
|---|---|---|---|---|---|---|---|---|
| | Toner | $\theta_{12}$ (degree) | Toner | $\theta_{22}$ (*degree) | Toner | $\theta_{23}$ (degree) | Toner | $\theta_{24}$ (degree) |
| Example β1 | Y3 | 88 | C1 | 94 | M1 | 93.5 | K1 | 95 |
| Example β2 | K3 | 88 | C1 | 94 | M1 | 93.5 | Y1 | 95 |

Evaluation Method

The produced printed items are used as test paper to prepare hand made sheets to be subjected to evaluation under the following conditions.

Pulping

An aqueous dispersion of the following formulation is stirred in a beaker at 50° C. for 20 min to pulp the test paper.

| | |
|---|---|
| Test paper | 5.0% |
| NaOH | 0.7% |
| Sodium silicate | 3.0% |
| $H_2O_2$ | 1.0% |

-continued

| | |
|---|---|
| De-inking agent ("LIPTOL S2800", manufactured by LION Corporation) | 0.2% |

Diluting, Dewatering, and Kneading

After diluting the aqueous dispersion subjected to the pulping to 5% with addition of water, it is dewatered by centrifugation, and further subjected to pulping with a kneader (kneading treatment) with adding pulp, sodium silicate and the like so that the concentration of the pulp (solids obtained by centrifugal dewatering) becomes 20%, sodium silicate becomes 3.0%, and NaOH becomes 0.5%.

Aging

The knead-pulped product after the kneading treatment is aged at 50° C. for 2 hours.

Floatation

Water is added to the aged product to prepare a liquid dispersion of 1%-pulp concentration. Fine bubbles are blown into the liquid dispersion for 7 min so that the toner in the liquid is adsorbed on the bubble and float to the water surface to separate the toner and water.

Cleaning

The deinked pulp is washed twice each time with 1 liter of water.

Preparation of Hand-Made Sheet for Evaluation

A hand-made sheet for evaluation (basis weight 75 $g/m^2$) is prepared by a Tappi sheet machine.

Evaluation of De-Inking Property

De-inking property is evaluated by measuring 5-point average brightness of the hand made sheet by a spectrodensito meter (trade name: X-RITE 939, manufactured by X-Rite Co.). Specifically, defining the brightness of a test paper not carrying the toner as L(0) and the brightness of the hand-made sheet for evaluation as L(1), the value $|L(0)-L(1)|$ is determined to evaluate the de-inking property. Further, difference between the color taste for the portion of the test paper not carrying the toner and that of the hand-made sheet used for evaluation is visually evaluated. The evaluation criteria are shown below. The result is shown in Table 4.

Evaluation Criteria According to Difference in Brightness

A: $|L(0)-L(1)| \leqq 2$

B: $2<|L(0)-L(1)| \leqq 4$

C: $4<|L(0)-L(1)|$

Evaluation Criteria for Visual Observation

A: Almost no difference is found in the color tastes.

B: Practically allowable, although small difference is found in the color tastes.

C: Difference in the color tastes is large.

Evaluation of Image Quality Under High Humidity Circumstance

The image quality of the printed item (that is, presence or absence of defects in the image area and fogging in the non-image area) is evaluated. The evaluation criteria are shown below. The result is shown in Table 4.

TABLE 4

| | De-inking property | | |
|---|---|---|---|
| | Difference in Brightness | Visual observation | Image quality |
| Example α1 | A | A | A |
| Example α2 | A | A | A |
| Example α3 | A | A | A |
| Example α4 | A | A | B |
| Comp. Example α1 | B | B | C |
| Example β1 | A | A | B |
| Example β2 | B | B | B |

A: Non-problematic for image quality (defects and fogging are not observed).

B: Practically allowable, although defects are observed in image area and fogging are observed in the non-image area.

C: Unacceptable. Defects in the image area and fogging in the non-image area are observed, and the materials are not practically usable.

As is understood from Table 4, Examples are superior in the de-inking property and provide better image quality as compared to Comparative example.

The foregoing description of exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its applications, thereby enabling others skilled in the art to understand the invention for various embodiments and with the various modifications as are suited to particular use contemplated. It is intended that the scope of the invention be defined by the following claims and their equivalents.

What is claimed is:

1. An image formation apparatus comprising a first toner image-forming unit, a second toner image-forming unit and a fixing unit, the first toner image-forming unit comprising:

a first electrostatic latent image holder;

a first electrostatic latent image forming unit that forms a first electrostatic latent image on the surface of the first electrostatic latent image holder;

a first developing unit that develops, with a first developer comprising a first toner, the first electrostatic latent image to form a first toner image; and a first transferring unit that transfers the first toner image to a recording medium so that the first toner image directly contacts a surface of the recording medium, the second toner image-forming unit comprising:

a second electrostatic latent image holder;

a second electrostatic latent image forming unit that forms a second electrostatic latent image on the surface of the second electrostatic latent image holder;

a second developing unit that develops, with a second developer comprising a second toner, the second electrostatic latent image to form a second toner image; and a second transferring unit that transfers the second toner image to the recording medium so that the second toner image is disposed on the first toner image without directly contacting the recording medium, the fixing unit fixing the transferred first toner image and the transferred second toner image on the surface of the recording medium, and a contact angle $\theta_1$, that is the contact angle of the first toner with respect to an aqueous de-inking solution, being smaller than a contact angle $\theta_2$, that is the contact angle of the second toner with respect to the aqueous de-inking solution.

2. The image formation apparatus of claim 1, wherein the value of $\theta_2$ minus $\theta_1$ is in the range of about 2.5° to about 10°.

3. The image formation apparatus of claim 1, wherein the L* value of the first toner defined in the CIE 1976 (L*a*b*) color system is larger than the L* value of the second toner.

4. The image formation apparatus of claim 1, wherein the first toner is a colorless toner that is substantially free of a colorant.

5. The image formation apparatus of claim 4, wherein the image formation apparatus comprises one or a plurality of the second toner image-forming unit(s), each using a color toner as the second toner, and the contact angle of the colorless toner with respect to the aqueous de-inking solution is smaller than any of the contact angles of the color toners with respect to the aqueous de-inking solution.

6. The image formation apparatus of claim 1, wherein: the first toner comprises a non-crystalline polyester resin formed by polymerizing monomer constituent units comprising an ethylene oxide adduct of bisphenol A; and the second toner comprises a non-crystalline polyester resin formed by polymerizing monomer constituent units comprising a propylene oxide adduct of bisphenol A.

7. The image formation apparatus of claim 6, wherein the weight-average molecular weight of the non-crystalline polyester resins are in the range of from about 5,000 to about 200,000.

8. The image formation apparatus of claim 6, further comprising a crystalline polyester resin having the weight-average molecular weight of from about 5,000 to about 70,000.

9. A printed item comprising a recording medium, a first toner image, and a second toner image, the first toner image directly contacting a surface of the recording medium, the second toner image residing on the first toner image without directly contacting the recording medium, and a contact angle $\theta_1$, that is the contact angle of the first toner image with respect to an aqueous de-inking solution, being smaller than a contact angle $\theta_2$, that is the contact angle of the second toner image with respect to the aqueous de-inking solution.

10. The printed item of claim 9, wherein the value of $\theta_2$ minus $\theta_1$ is in the range of about 2.5° to about 10°.

11. The printed item of claim 9, wherein the L* value of the first toner image defined in the CIE 1976 (L*a*b*) color system larger is than the L* value of the second toner image.

12. The printed item of claim 9, wherein the first toner image is formed of a colorless toner that is substantially free of a colorant.

13. The printed item of claim 12, wherein the printed item comprises one or a plurality of the second toner image(s), each being a color toner image, and the contact angle of the colorless toner image(s) with respect to the aqueous de-inking solution is smaller than any of the contact angles of the color toner images with respect to the aqueous de-inking solution.

14. The printed item of claim 9, wherein: the first toner image comprises a non-crystalline polyester resin formed by polymerizing monomer constituent unit comprising an ethylene oxide adduct of bisphenol A; and the second toner image comprises a non-crystalline polyester resin formed by polymerizing monomer constituent unit comprising a propylene oxide adduct of bisphenol A.

15. The printed item of claim 14, wherein the weight-average molecular weight of the non-crystalline polyester resins are in the range of from about 5,000 to about 200,000.

* * * * *